US010669118B2

(12) United States Patent
Mcnestry

(10) Patent No.: US 10,669,118 B2
(45) Date of Patent: Jun. 2, 2020

(54) SPOOL SUPPORT

(71) Applicant: VIDEOJET TECHNOLOGIES INC., Wood Dale, IL (US)

(72) Inventor: Martin Mcnestry, Derbyshire (GB)

(73) Assignee: VIDEOJET TECHNOLGOIES INC., Wood Dale, IL (US)

( * ) Notice: Subject to any disclaimer, the term of this patent is extended or adjusted under 35 U.S.C. 154(b) by 907 days.

(21) Appl. No.: 14/901,560

(22) PCT Filed: Oct. 1, 2014

(86) PCT No.: PCT/GB2014/052964
§ 371 (c)(1),
(2) Date: Dec. 28, 2015

(87) PCT Pub. No.: WO2015/049511
PCT Pub. Date: Apr. 9, 2015

(65) Prior Publication Data

US 2016/0159610 A1 Jun. 9, 2016

(30) Foreign Application Priority Data

Oct. 3, 2013 (GB) ..... 1317531.0
May 6, 2014 (GB) ..... 1407979.2

(51) Int. Cl.
*B65H 75/24* (2006.01)
*B65C 9/18* (2006.01)

(52) U.S. Cl.
CPC ..... *B65H 75/246* (2013.01); *B65C 9/1892* (2013.01)

(58) Field of Classification Search
CPC ..... B65H 75/246; B65C 9/1892
USPC ..... 242/575, 574, 574.2, 586, 586.4; 279/2.09
See application file for complete search history.

(56) References Cited

U.S. PATENT DOCUMENTS 1,135,388 A * 4/1915 Miser ..... B65H 75/246 242/575.3
1,492,291 A * 4/1924 Egisto ..... B65H 75/246 242/571.6
2,586,527 A * 2/1952 Ferm ..... B21C 47/30 242/532.6
3,061,224 A * 10/1962 Herr ..... B21C 47/30 242/573.8
3,337,151 A 8/1967 Parkinson
(Continued)

FOREIGN PATENT DOCUMENTS

CH 583136 12/1976
GB 1543571 4/1979
(Continued)

*Primary Examiner* — Michael R Mansen
*Assistant Examiner* — Mark K Buse
(74) *Attorney, Agent, or Firm* — Beusse, Wolter, Sanks & Maire PLLC; Robert L. Wolter

(57) ABSTRACT

A spool support, for supporting a windable material, comprises a main body, an actuator and a clamp portion. The actuator is movable relative to the main body between a first position and a second position. The clamp portion is pivotably connected to the main body. The actuator actuates the clamp portion such that the clamp portion pivots relative to the main body between a retracted position when the actuator is in the first position and a deployed position when the actuator is in the second position.

20 Claims, 12 Drawing Sheets

(56) References Cited

U.S. PATENT DOCUMENTS

| | | | | | |
|---|---|---|---|---|---|
| 3,774,862 | A * | 11/1973 | Rodach | B21C 47/323 | 242/573.8 |
| 3,815,839 | A * | 6/1974 | Madachy | B21C 47/30 | 242/571.1 |
| 4,193,633 | A * | 3/1980 | Potter | B65H 75/246 | 242/571.7 |
| 4,713,128 | A | 12/1987 | Kerwin | | |
| 5,490,640 | A * | 2/1996 | Miller | B65H 75/246 | 242/571.6 |
| 2003/0116675 | A1* | 6/2003 | Heuser | B65H 75/246 | 242/571 |
| 2007/0278342 | A1* | 12/2007 | Harkins | B65H 19/305 | 242/571 |

FOREIGN PATENT DOCUMENTS

| | | |
|---|---|---|
| GB | 2064471 | 12/1983 |
| WO | 2012097906 | 7/2012 |

* cited by examiner

SPOOL SUPPORT

The present invention relates to a spool support of the kind that may be used, for example, as a take-up spool support or supply spool support in a labelling machine for use with webs carrying a plurality of labels. Such machines are sometimes referred to as 'roll-fed self-adhesive labelling machines'.

Labels are commonly used to display information relating to an article and are disposed on the article such that the information is easily readable either manually or automatically. Such labels may, for example, display product information, barcodes, stock information or the like. Labels may be adhered to a product or to a container in which the product is packaged.

A web carrying labels is usually manufactured and supplied as a wound roll. This roll, when supported on a supply spool support of a labelling machine, is commonly referred to as a supply spool. For a given supply spool, all the labels are typically the same size, within manufacturing tolerances and detachably mounted on a backing web. For convenience the term "web" is herein used interchangeably to mean a backing web carrying labels and also to mean a backing web from which labels have been removed, the sense in each case being immediately apparent from the context.

One common type of conventional roll-fed self-adhesive labelling machine has a supply spool support and a take-up spool support. The supply spool is supported on the supply spool support. During use of the labelling machine, the web from the supply spool is progressively advanced along a web path between the supply spool and a take-up spool. The label web is advanced under tension, unwinding it from the supply spool and winding it onto the take-up spool support (thereby forming the take-up spool). At one point along the web path the web is passed around a 'peel beak', which acts to remove labels from the web so that they can be attached to a product or container. The web is advanced along the web path by a drive mechanism. The drive mechanism may drive the take-up spool support so as to wind web onto a take-up spool, may drive the supply spool support so as to release web from a supply spool, and/or may drive one or more 'pinch' rollers, disposed at a point along the web path, against which the web passes.

As indicated above, the web must be advanced along the web path under tension. More particularly, it must pass round the peel beak under sufficient tension to allow separation of the labels from the backing web, but must not be tensioned to the point where fracture or distortion of the web may occur. The application of tension to the web is commonly performed by the drive mechanism. For instance, the drive mechanism may drive both the take-up spool support and the supply spool support, and control the amount of tension applied to the web by controlling the rotation of each spool support separately (for example it may increase the amount of tension by increasing the speed of the take-up spool support relative to the supply spool support). In an alternative arrangement, the drive mechanism may drive only the take-up spool support and the tension may be applied by exerting a braking force on an otherwise free-wheeling supply spool support.

Supply spools of label web are often supplied wound on an inner tube or core, akin to a roll of adhesive tape. The supply spool support may be actuated so as to allow the spool support to firmly grip the inner tube, but release it when desired (e.g. to change supply spools). One example of a known supply spool support has a pair of elastomeric rings, running around the circumference of the supply spool, and spaced along the height of the supply spool. The elastomeric rings can be axially compressed, flattening them and causing them to expand radially. With the rings in their relaxed state, the diameter of the supply spool support is small enough to allow removal of the inner tube of a depleted supply spool, and to allow a replacement supply spool to be installed. The rings are then compressed, causing them to expand radially and grip the inside of the new supply spool's inner tube, preventing the supply spool from falling off the support and ensuring that the supply spool will only rotate if the supply spool support does so as well.

The take-up spool is often formed directly on the take-up spool support. An end of the web is mounted to the take-up spool support so that as the latter rotates, the web is wound onto it. The take-up spool support may be actuated so as to firmly grip an end of a label web, but release it when desired (e.g. to remove the take-up spool for disposal). One example of a known take-up spool support has a longitudinal slot in it, and a longitudinal bar which is located radially inwards of the slot in a first position and which can be moved radially outwards to a second position in which the bar projects into the slot. By inserting an end of a label web into the slot and then moving the bar into the second position, the bar grips the end of the label web against an edge of the slot. The take-up spool can then be formed by rotating the take-up spool support. When the take-up spool is to be removed, the bar is moved back to the first position so that the end of the web is released.

One problem with the above designs is that the application of force may not be uniform across the height of the spool supports (e.g. along the width of any roll of label web supported by the spool support—the width of the roll being the size of the roll along its axis of rotation). For instance, in the case of the supply spool support above which includes two compressible elastomeric rings, the force is applied solely in two small areas along its height. If a supply spool of relatively short width is mounted to the supply spool support, only one of the two elastomeric rings may lie within its inner tube. In such a case, the short supply spool may experience a desired clamping force which is less than desired. Further, the mechanism by which the rings are deformed may be such that if one ring (i.e. the ring which is not within the core of the supply spool) is freely deformable due to being outside of the inner tube of the supply spool, most or all deformation may occur at this ring and little or none at the ring within the supply spool's inner tube. This could mean that little or no clamping force is applied to a spool supported by the spool support via the ring within the supply spool inner tube. This may in turn allow relative rotation between the spool support and a spool mounted thereon. Relative rotation between a spool support and supported spool may prevent the application of sufficient tension to the web along the web path, and/or prevent the spools from advancing the label web with sufficient precision.

In the case of the above described take-up spool support having a longitudinal slot, the mechanism which moves the bar between the first and second positions is usually mounted to the bar at its central point. If an end of a relatively narrow label web is inserted into the slot so that it lies more at one end than the other, when the bar is in the second position the connection at its centre may flex, allowing the bar to tip or tilt so that the end further from the web projects into the slot while the other end remains radially inwards of it. This may reduce the force applied to the end of the label web, allowing it to slip or to work free, which may bring about relative rotation between the spool and spool support and thus the problems described above in relation to web tension and positioning precision.

In addition, supply spool supports and take-up spool supports conventionally utilise entirely different mechanisms, therefore it is not possible to use one type of spool support for both supply spool supports and take-up spool supports. This increases the complexity of the design and production processes involved in making a labelling machine, thereby increasing its cost.

Furthermore, in labelling machines in which the label web is driven along the web path by rotation of the take up spool by a known take up spool support, the take up spool can become tightly wound onto the take up spool support, making removal of the take up spool from the take up spool support difficult.

It is one object of the present invention to mitigate or obviate at least one of the disadvantages present in the prior art, whether previously described or otherwise, and/or to provide an improved or alternative spool support or labelling machine.

According to a first aspect of the present invention there is provided a spool support for supporting a length of windable material, the spool support comprising support for supporting a windable material, the spool support comprising a main body, an actuator, and a clamp portion; wherein the actuator is movable relative to the main body between a first position and a second position; and wherein the clamp portion is pivotably connected to the main body, the actuator actuating the clamp portion such that the clamp portion pivots relative to the main body between a retracted position when the actuator is in the first position and a deployed position when the actuator is in the second position.

The clamp portion being pivotably movable may be advantageous in ensuring uniform force distribution. For instance, the clamp portion being constrained to move about a pivot axis may reduce or eliminate the possibility of it becoming misaligned when acting on a relatively narrow width of label web (or other medium) or relatively axially short spool. This may minimise the potential for the clamp portion to provide insufficient and/or varied force across its axial length. Further, use of a pivotal clamp portion may allow the same spool support to be utilised either by clamping an end of a label web (or other medium) or by gripping the inside of an inner tube, which may provide advantageous versatility. In this way, a spool support according to the present invention may be used as a supply spool support or a take-up spool support within a machine which winds windable material from a supply spool support to a take-up spool support, for example, a labelling machine.

The clamp portion may be pivotable about a pivot axis that is substantially parallel to a longitudinal axis of the spool support structure. The longitudinal axis may be an axis about which the spool support is rotated in use in order to permit the winding or unwinding of said windable material.

The spool support may be configured to attach a portion of windable material to the spool support when the clamp portion is in said deployed position, and configured to allow removal of portion of windable material from the spool support when the clamp portion is in said retracted position. Alternatively, the spool support may be configured to attach a portion of windable material to the spool support when the clamp portion is in said retracted position, and allow removal of a portion of windable material from the spool support when the clamp portion is in said deployed position.

The windable material may be a spool of windable material. The spool may or may not have a central core formed from a material which is different to the windable material. The portion of windable material which may be attached to or removed from the spool support may be the end of a length of windable material, the centre of a spool of windable material which has no central core of material different to the windable material or the centre of a spool of windable material which has a central core of material different to the windable material.

In one embodiment, the main body and clamp portion cooperatively define a spool support structure, the spool support structure defining a longitudinal axis and having an outer periphery that surrounds the longitudinal axis, the outer periphery being configured for direct or indirect engagement with said windable material.

In the above embodiment, the outer periphery may be configured for indirect engagement with said windable material and said indirect engagement with said windable material may be via a core around which said windable material is wound. Alternatively, the outer periphery may be configured for direct contact with said windable material. For instance, the windable material may be wound directly onto the spool support.

The clamp portion may define at least part of the outer periphery of the spool support structure. This may increase the functionality of the spool support by allowing the clamp portion to grip the inside of an inner tube of a spool (or enable the clamp portion to be a portion around which a spool will be formed).

As an alternative, the outer periphery may be defined entirely by the main body. For instance, the clamp portion may be recessed radially inwards of the outer periphery.

Where the clamp portion defines at least part of the outer periphery of the spool support structure, the part of the outer periphery defined by the clamp portion may include a resiliently deformable portion suitable for said engagement with a spool. This may allow the spool support to accommodate and secure spools of inconsistent internal diameter and/or different spools having different diameters. For instance, the spool support may be able to grip the inside of supply spools' inner tubes where these inner tubes are manufactured to relatively broad dimensional tolerances.

The entire portion of the outer periphery that is provided by the clamp portion may be resiliently deformable. In an arrangement where the entire outer periphery is provided by the clamp portion, the spool support would have an outer periphery the entirety of which was resiliently deformable.

Alternatively or in addition, where the main body defines at least part of the outer periphery, that part may include a resiliently deformable portion.

Where the clamp portion defines at least part of the outer periphery of the spool support structure, the part of the outer periphery defined by the clamp portion may include a high-friction surface. For instance, the entire portion of the outer periphery that is provided by the clamp portion may be a high-friction surface.

The high-friction surface may be a knurled or toothed surface, an adhesive layer or an elastomeric pad or insert. Alternatively, it may take any other suitable form.

Alternatively or in addition, where the main body defines at least part of the outer periphery, that part may include a high-friction surface.

The high friction surface may be provided by a resiliently deformable portion.

When the clamp portion is in the deployed position, the outer periphery of the spool support structure may be substantially circular in longitudinal cross section. In this case, longitudinal cross-section means a cross-section perpendicular to the longitudinal axis of the spool support (e.g.

perpendicular to a rotation axis of the spool support in use). The substantially circular cross-section may allow the spool support to maintain a substantially circular cross-section of a spool formed or mounted thereon, which may allow advantageously simple control of a machine of which the spool support is a part (as explained below). Alternatively, the spool support portion may have any other suitable longitudinal cross-section. For instance, it may be a prism such as a triangular, square, pentagonal, hexagonal or octagonal prism. Such a spool support portion may be suitable for engagement with a spool of windable material supported on a relatively inflexible core. The edges of a spool support with a prism longitudinal cross-section may provide additional traction with the core, while the core may be strong enough to substantially prevent the spool being deformed.

The clamp portion may be pivotable about a pivot axis that is substantially parallel to the longitudinal axis of the spool support structure. For the avoidance of doubt, the term 'parallel' is intended to include collinear. As an alternative, the clamp portion may be pivotable about a pivot axis that is substantially perpendicular to the longitudinal axis of the spool support structure, or may be pivotable in any other suitable direction.

At least part of the clamp portion may be spaced a greater distance from the axis in the deployed position than said at least part of the clamp portion is spaced from the axis in the retracted position.

The clamp portion may define at least one of a pair of opposed jaws, the jaws having an open configuration when the clamp portion is in the retracted, in which insertion or removal of a portion of windable material is permitted, and a closed configuration when the clamp portion is in the deployed position, in which a portion of windable material may be clamped between the jaws. This may advantageously increase the functionality of the spool support by allowing a take-up spool to be formed directly thereon by clamping a portion of the windable material between the jaws and rotating the spool support so as to form the spool.

One of said pair of jaws may be provided by the clamp portion and the other may be provided by the main body. In one alternative, both jaws may be provided by the clamp portion, the jaws being movable between open and closed configurations by an actuator or by another mechanism during movement of the clamp portion between the deployed and retracted positions.

Said relative movement between the actuator and main body may be a relative rotation. In other embodiments the relative movement between the actuator and main body may be another form of relative movement, such as linear movement.

The relative rotation between the main body and the actuator may be substantially about the about the longitudinal axis of the spool support structure. Likewise, if the relative movement between the main body and the actuator is a linear movement, the relative movement may be substantially parallel to and/or collinear with the longitudinal axis of the spool support structure. In particular, some embodiments may include an actuator having a portion which interacts with a user (e.g. a handle, a button, a lever or the like) and a linkage portion which converts movement of the portion which interacts with a user to movement which urges the clamp portion into the deployed or retracted position. In some such embodiments a portion of the linkage portion may move in a plane perpendicular to the longitudinal axis and/or pivot axis.

The spool support may further comprise a ramp and a ramp-engaging structure, one of which is provided by the actuator and the other of which is provided by the clamp portion, the ramp and ramp-engaging structure being configured such that said relative movement of the actuator and main body from the first position to the second position moves the ramp-engaging structure up the ramp, thereby camming the clamp portion into the deployed position.

For the avoidance of doubt, reference to the ramp-engaging structure travelling 'up' the ramp is made for figurative purposes and is not intended to limit this arrangement to the ramp-engaging structure moving in any particular frame of reference other than relative to the ramp. For instance, the ramp-engaging structure may remain entirely stationary and be traversed by the ramp. As an example, the ramp may be provided on a cam and the ramp-engaging structure on a cam follower.

The ramp-engaging structure may include a roller or wheel configured to roll up the ramp during said relative movement of the actuator and main body from the first position to the second position. The ramp-engaging structure may comprise the roller or wheel as well as other components.

In an alternative arrangement, the clamp portion may be actuated via any other suitable mechanism, such as a three-bar linkage or a scissor linkage.

The spool support may further comprise a resilient member configured to urge the actuator relative to the main body towards the first position when disturbed therefrom.

Alternatively or in addition, the spool support may further comprise a resilient member configured to urge the actuator relative to the main body towards the second position when disturbed therefrom. Where an arrangement has both of the above, the resilient member configured to urge the actuator relative to the main body towards the first position may be the same as the resilient member configured to urge the actuator relative to the main body towards the second position. Alternatively, such an arrangement may utilise two separate resilient members.

There may be a threshold disturbance magnitude (i.e. the extent of relative movement of the actuator and main body) beyond which the resilient member ceases to have an effect. For instance, where movement of the main body and actuator between the first and second positions entails relative rotation of 90 degrees, the threshold may be about 45 degrees. It will be appreciated that in other embodiments, movement of the main body and actuator between the first and second positions may entail any appropriate amount of relative rotation and the threshold may also be any appropriate amount of rotation.

The actuator and main body may be movable relative to one another between the first and second positions via an intermediate position, the spool support comprising a resilient member configured to provide an over-centre bias between the main body and actuator by urging the actuator and main body away from the intermediate position. In other words, the spool support structure and actuator may be bi-stable, the stable states being the first and second positions. For the avoidance of doubt, the intermediate position may not be equidistant between the first and second positions.

The resilient member which urges the main body and actuator away from the intermediate position is preferably configured to urge them towards the first position when disturbed therefrom, and/or to urge them towards the second position when disturbed therefrom. In other arrangements however, the resilient member which urges the main body and actuator away from the intermediate position may not urge them as far as the first position or the second position.

In any of the above arrangements utilising a resilient member, the resilient member may be a spring, such as a coil spring, gas spring, torsion spring or leaf spring, may be an elastomeric rod, pad or block, or may take any other suitable form.

The main body, and/or the spool support structure, may define a cavity within which at least part of the actuator is received. Preferably, substantially all the actuator is received within said cavity.

The spool support may further comprise an additional clamp portion, wherein the additional clamp portion is pivotably connected to the main body, the actuator actuating the additional clamp portion such that the additional clamp portion pivots relative to the main body between a retracted position when the actuator is in the first position and a deployed position when the actuator is in the second position.

Use of two clamp portions may allow the force applied to the inside of an inner tube to be more balanced around its circumference, which may improve traction and/or maintain the circular shape of a spool.

The additional clamp portion may have one or more of the features described above in relation to the clamp portion. For instance, the additional clamp portion may comprise at least one of a pair of jaws.

The additional clamp portion may be actuated towards the deployed position by the same mechanism that also moves the clamp portion towards the deployed position.

The spool support may comprise any appropriate number (for example three, four or more) of clamp members, each of which may or may not have any of features described above in relation to the clamp member.

The main body may be configured to be secured to a mandrel suitable for driving the spool support for rotation.

The spool support may instead be supported, drivingly or otherwise, in any other suitable fashion.

The spool support may be a take up spool of a labelling machine, the spool support being suitable for supporting label web. The spool support may be a supply spool of a labelling machine, the spool support being suitable for supporting label web.

The or each clamp portion may further comprise a plurality of ribs, the ribs extending from the outer surface of the clamp portion.

The ribs support the clamped core between primary clamping locations, reducing the extent to which the clamped core is deformed during clamping.

When the clamp portion is in the deployed position, an outermost point of each of the plurality of ribs may lie on an arc, the arc having a predetermined radius from a longitudinal axis of the spool support structure.

The outermost point of each of the ribs lying on an arc having a predetermined radius reduces the extent to which a clamped core is deformed when clamped on the spool support, improving the circularity of the clamped core.

The or each clamp portion may comprise an inner surface, a first portion of which is configured as the ramp and a second portion which is configured as a plateau portion having a substantially constant radius from a longitudinal axis when in the deployed position.

The provision of a ramped first portion and a plateau second portion allows the clamp portion to be moved from a retracted position to a deployed position by the action of the ramp engaging portion, and also ensures that when it has reached the deployed position, the radial position of the clamp portion does not move any further.

The first portion and the second portion may be provided adjacent to one another as a continuous surface.

Providing the first and second portions adjacent to one another as a continuous surface allows a smooth transition to be made when moving from the retracted to the deployed position and vice versa.

The or each clamp portion may be biased towards the retracted position by a second resilient member, and the clamp portion and the second resilient member may be configured such that when the clamp portion is in the deployed position the force, resulting from the second resilient member acting on the clamp portion, exerted by the clamp portion on the ramp engaging portion has a direction which intersects an axis of rotation of the ramp engaging portion, such that the force, resulting from the second resilient member acting on the clamp portion, exerted by clamp portion on the ramp engaging portion does not urge the ramp engaging portion towards the ramp.

The arrangement of the second resilient member and the clamp portion such that the force exerted by the clamp portion on the ramp engaging portion does not urge the ramp engaging portion towards the ramp allows the resilient member to ensure a reliable return of the clamp portion to the retracted position when in an intermediate position, while also ensuring the stability of the clamp portion when in the deployed position.

According to a second aspect of the present invention there is provided a labelling machine comprising a supply spool support for supporting a supply spool that comprises a length of label web, the label web releasably supporting a plurality of labels positioned along its length; a take-up spool support for supporting a take-up spool that comprises a length of label web; a web path defined between the supply spool support and the take-up spool support; and a drive mechanism arranged to advance label web along the web path, from a supply spool supported by the supply spool support to a take-up spool supported by the take-up spool support, wherein the at least one of the supply spool support and the take-up spool support is a spool support according to the first aspect of the invention.

The second aspect of the invention may provide a labelling machine which offers one or more of the advantages discussed in relation to the first aspect of the invention.

According to a third aspect of the present invention there is provided a printer comprising a supply spool support for supporting a supply spool that comprises a length of printer ribbon; a take-up spool support for supporting a take-up spool that comprises a length of printer ribbon; a web path defined between the supply spool support and the take-up spool support; and a drive mechanism arranged to advance printer ribbon along the web path, from a supply spool supported by the supply spool support to a take-up spool supported by the take-up spool support, wherein the at least one of the supply spool support and the take-up spool support is a spool support according to the first aspect of the invention.

The third aspect of the invention may provide a printer machine which offers one or more of the advantages discussed in relation to the first aspect of the invention.

The printer may be comprised within a labelling machine, which may or may not be a labelling machine according to the second aspect of the invention.

A specific embodiment of the present invention will now be described, by way of example only, with reference to the accompanying drawings in which.

Figure 1:
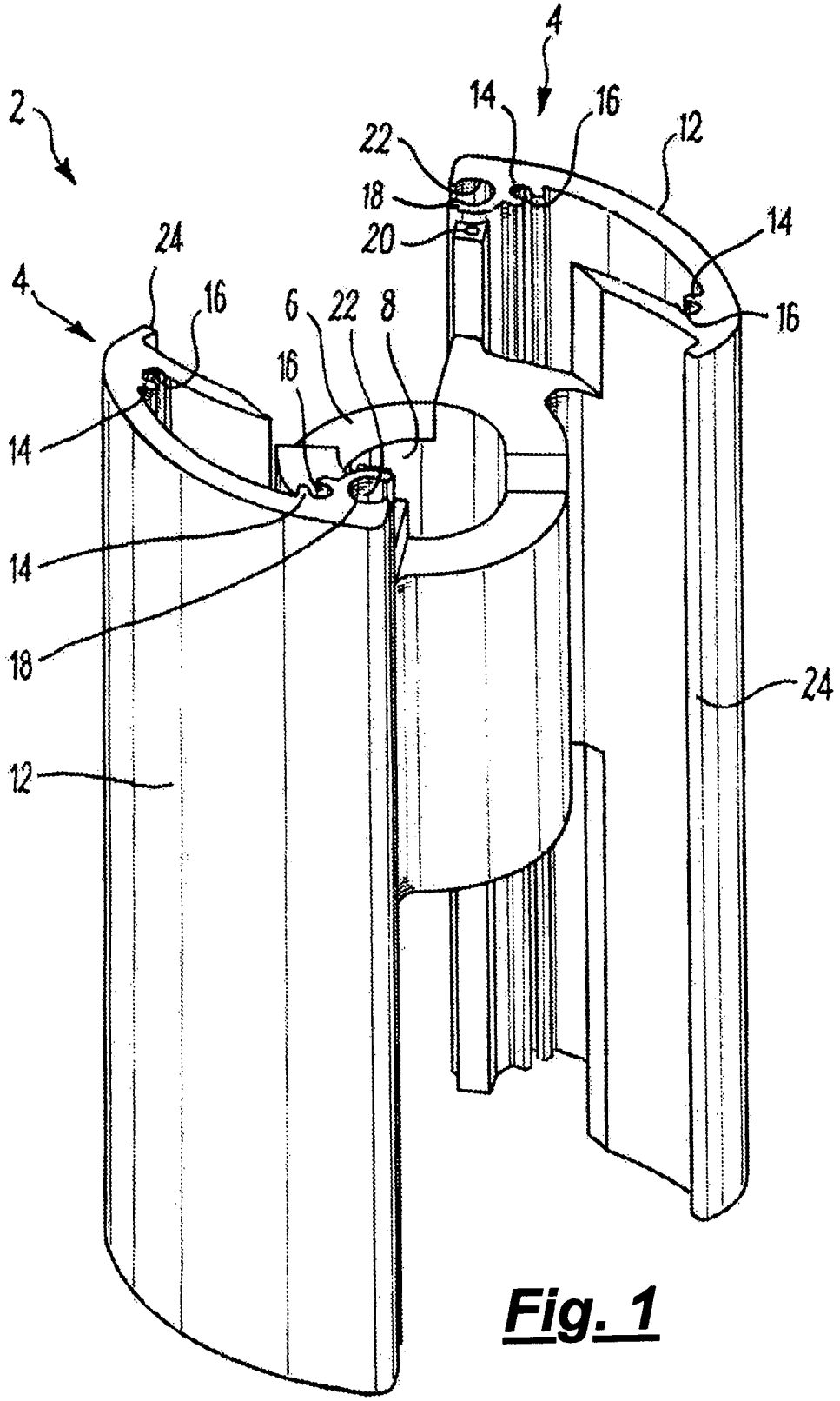
FIG. 1 is a perspective view of a main body of a spool support according to an embodiment of the invention.
Figure 2:
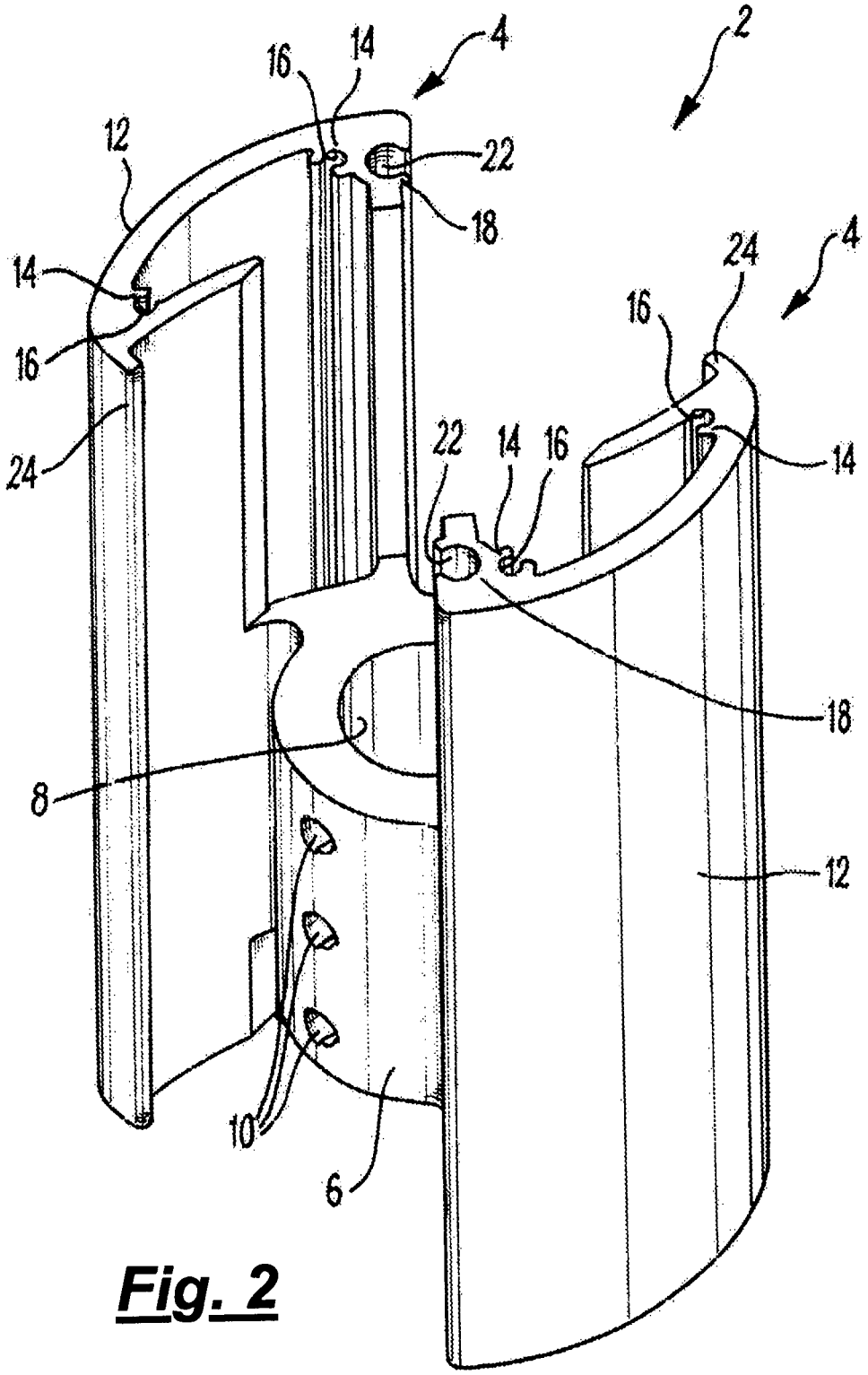
FIG. 2 is a perspective view of the main body of FIG. 1 from a different angle.
Figure 3:
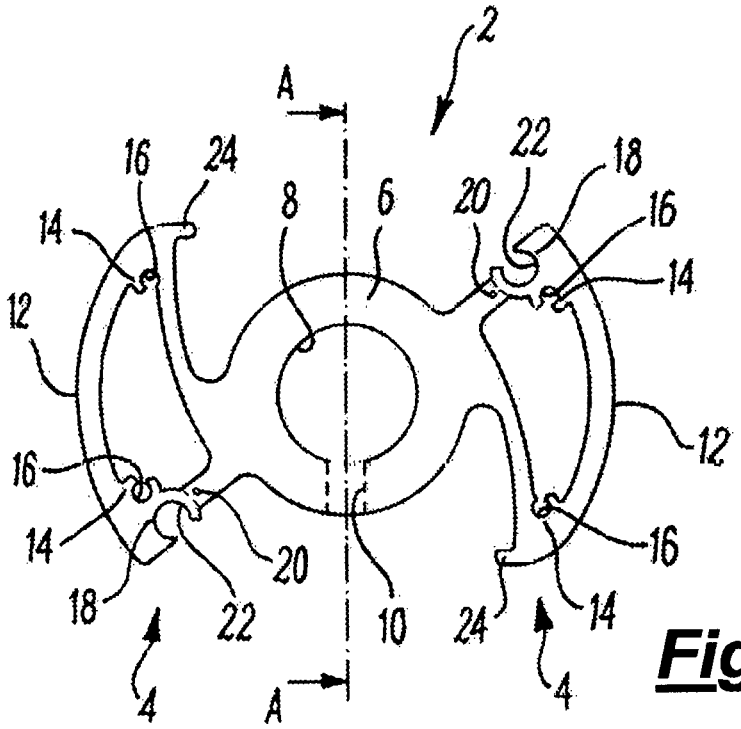
FIG. 3 is an axial cross-section of the main body of FIGS. 1 and 2.
Figure 4:
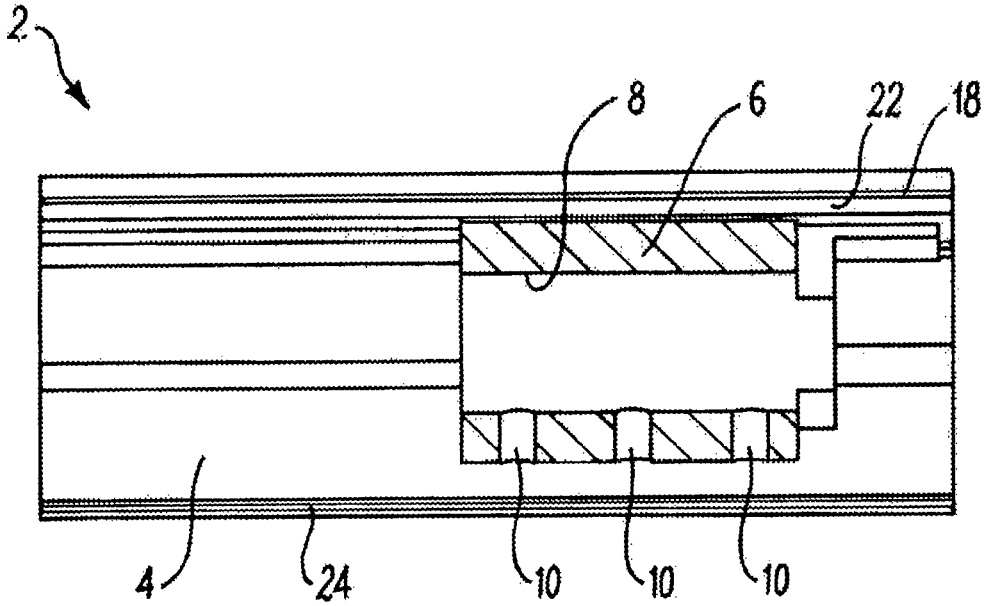
FIG. 4 is a lateral cross section of the main body of FIGS. 1-3, taken along line A-A of FIG. 3.

FIGS. 1-4 show a main body 2 of a spool support according to an embodiment of the invention. It has two lobes 4, connected together by a substantially tubular shroud 6 with a bore 8 centrally positioned therein. The shroud 6 defines a main body longitudinal axis which runs through the bore 8, running vertically from the perspective of FIGS. 1 and 2, running into the page from the perspective of FIG. 3 and running horizontally from the perspective of FIG. 4. In other words, the central bore 8 (and thus the entire shroud 6) is concentric with the main body longitudinal axis. The shroud 6 has three transverse threaded bores 10 which each intersect the bore 8 in the shroud 6. In this embodiment the bores 10 are aligned substantially radially, but this need not be the case in other embodiments.

The shroud 6 is significantly axially shorter than the lobes 4, and is positioned nearer one axial end of the main body 2. The axial end of the main body 2 which the shroud 6 is nearer will be referred to as the 'top' end and the opposite end will be referred to as the 'bottom' end, and this convention will also be applied to description of the other components of the spool support. However, it is to be understood that this should not be interpreted to require any specific spatial orientation of the main body 2 or any other component of the spool support. For instance, from the perspective of FIG. 2 the 'top' of the main body 2 is underneath the 'bottom'.

The lobes 4 are substantially identical, and are positioned at substantially diametrically opposite points around the main body longitudinal axis (and thus around the shroud 6). The main body 2 is therefore substantially rotationally symmetrical (order 2) about its longitudinal axis. Each lobe 4 (and thus the main body 2) forms part of a spool support structure. Each has an arcuate outer surface 12 which forms part of the outer periphery of a spool support structure. The spool support structure will be described in more detail below.

Each lobe 4 is substantially hollow in axial cross section (which reduces the weight of the main body 2) and defines two screw-engagement profiles 14. Each screw engagement profile 14 is substantially C-shaped and defines an open-sided substantially cylindrical bore 16 for receiving a screw. In this embodiment the main body 2 is made from a single length of extrusion (for example, aluminium—of course any other appropriate material may be used), with the axial faces of the shroud 6 milled back from the top and bottom faces of the lobes 4. The screw engagement profiles 14 are C-shaped, rather than tubular, so as to allow the extrusion die to be of simpler construction (and therefore cheaper). This also reduces the weight of the main body 2.

The lobes 4 each also have an axle socket 18, and a blind hole 20 (the blind holes are not formed as part of the extrusion, but are drilled subsequently). The axle sockets 18 are substantially C-shaped and each define an open-sided substantially cylindrical slot 22. Each lobe 4 also has a longitudinal rib 24. The purpose of these components will be explained in more detail below.

Figure 5:
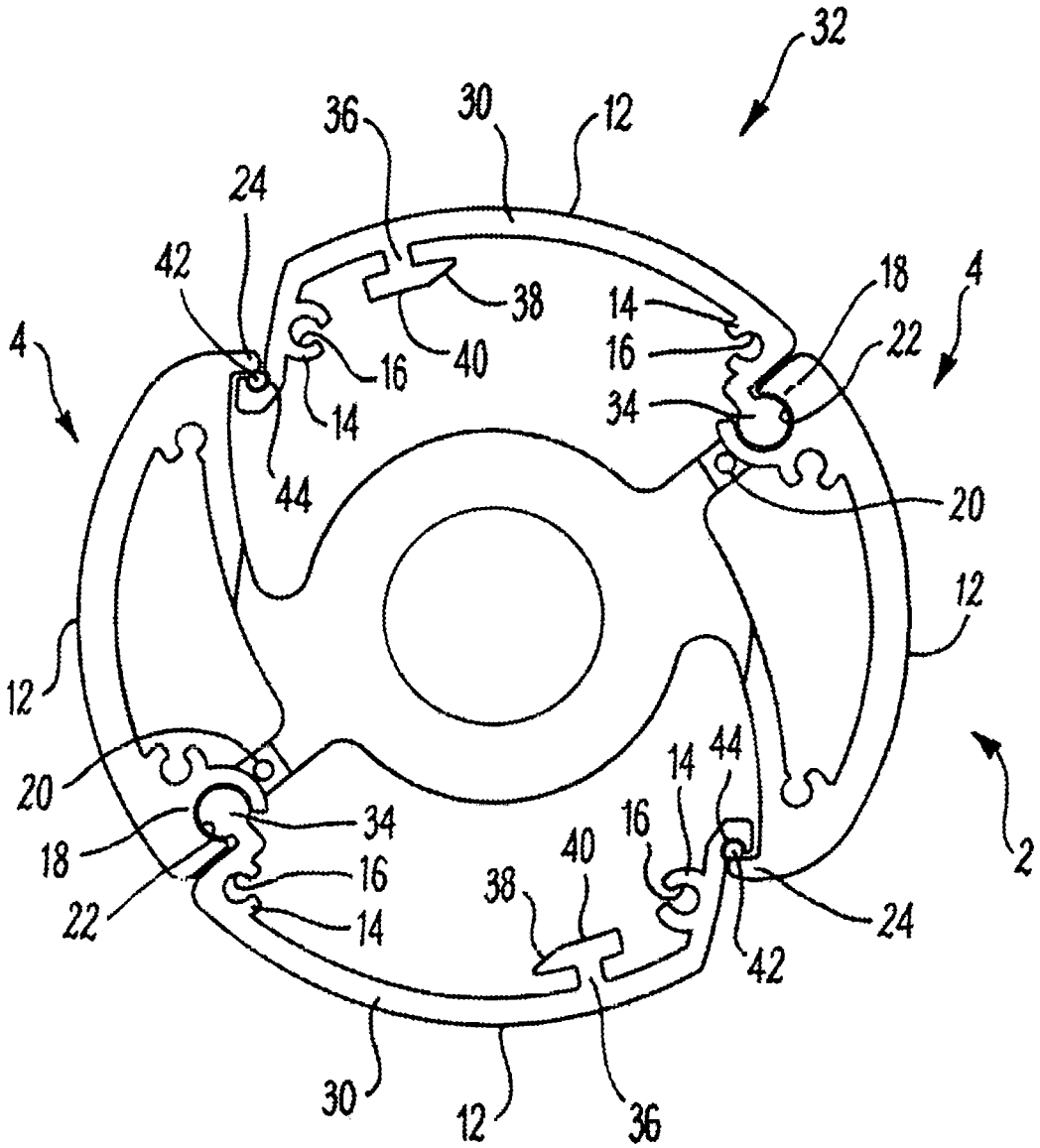
FIG. 5 is an axial cross section of a spool support structure of the embodiment.

FIG. 5 shows the main body 2 with two clamp portions 30 attached thereto, forming the spool support structure 32. In this embodiment the spool support structure 32 has a common longitudinal axis with the main body 2, therefore it is to be understood that reference herein to position or motion relative to the axis of the main body may equally be considered to refer to the axis of the spool support structure, and vice versa. Like the lobes 4, the clamp portions 30 are substantially identical and are substantially diametrically opposed about the main body longitudinal axis. The spool support structure 32 is therefore also substantially rotationally symmetrical (order 2) about its longitudinal axis. The clamp portions 30 also have arcuate outer surfaces 12 which form part of the outer periphery of the spool support structure 32. The arcuate outer surfaces 12 of the lobes 4 and the clamp portions 30 co-operatively form substantially all the outer periphery of the spool support structure. With the spool support structure 32 in the configuration shown in FIG. 5, its outer periphery is substantially cylindrical and is positioned substantially circumferentially about its longitudinal axis.

Each clamp portion has a substantially cylindrical axle ridge 34 which is received in the substantially cylindrical slot 22 of the axle socket 18 of one of the lobes 4. The axle ridge 34 and axle socket 18 co-operatively form a hinge mechanism, defining a pivot axis about which the clamp portion 30 can pivot relative to the main body 2. The pivot axes in this embodiment are substantially parallel to the longitudinal axis of the main body 2, and are substantially collinear with the axes of the cylindrical slots 22. As described in more detail below, each clamp portion 30 can pivot relative to the main body 2 between a retracted position and a deployed position. FIG. 5 shows both clamp portions 30 in their deployed positions.

The clamp portions 30, like the axially fixed portions 4, each define two substantially C-shaped screw-engagement profiles 14 with open-sided substantially cylindrical cavities 16 for receiving screws. In addition, each clamp portion 30 has a ramp section 36 with a ramp face 38 and a circumferentially-extending face 40. Each clamp portion 30 is a section of extrusion, and indeed both clamp portions 30 may be sections of the same extrusion (which in this case is made of aluminium). The approximately T-shaped cross section of the ramp sections allows the material thickness of the clamp portion to be more uniform, so as to enable easier extrusion of the profile. This also reduces the weight and material cost of the spool support structure. Each clamp portion 30 also has a resilient portion, in the form of a substantially cylindrical neoprene foam insert 42 received within a longitudinal groove 44 in the clamp portion. In FIG. 5 the inserts 42 are shown deformed by the ribs 24 of the lobes 4, as described below. In other embodiments the resilient portions may have any appropriate configuration and may be formed of any appropriate material.

Figure 6:
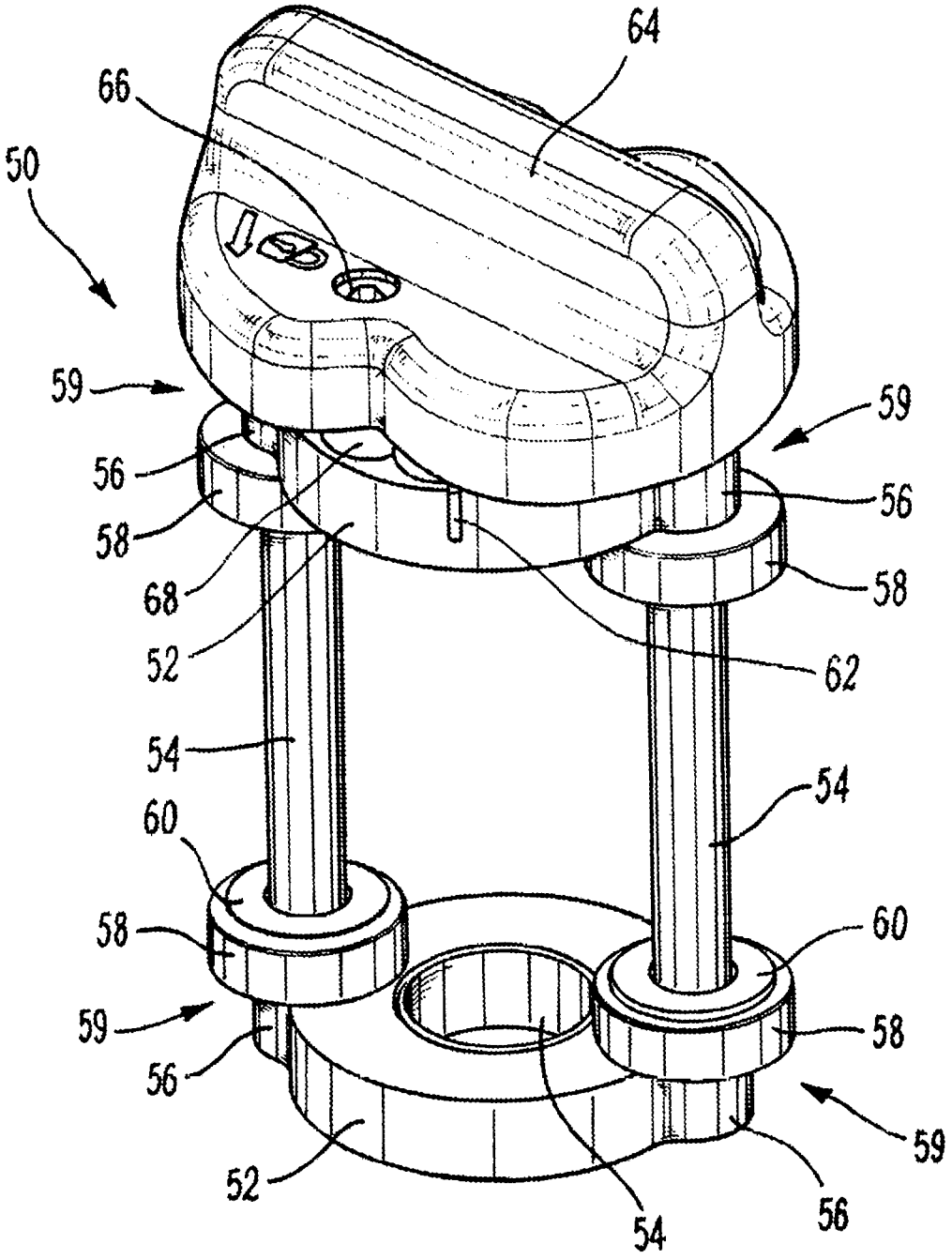
FIG. 6 is a perspective view of an actuator of the embodiment.

FIG. 6 shows an actuator 50 of the spool support. The actuator 50 comprises two collar plates 52. A pair of spacer rods 54 bolted to each of collar plates by screws 65 (shown in FIGS. 7 and 9 to 11) holds the collar plates 52 at a fixed distance apart. Each collar plate 52 is approximately circular, with an aperture 54 positioned at its centre. The apertures 54 define an actuator longitudinal axis (which is vertical from the perspective of FIG. 6) with which they are concentric. Each collar plate 52 also has a pair of substantially diametrically-opposed lugs 56, which are the portions of the collar plates 52 to which the spacer rods 54 are bolted by screws 65. Each lug 56 has a wheel 58, the lug and wheel together forming a ramp-engaging structure 59. The spacer rod 54 to which a lug 56 is attached acts as an axle for the wheel 58 of that lug, allowing the wheel to rotate around it. In this embodiment, each wheel 58 is mounted on a bearing 60 which is axially fixed relative to the spacer rod 54 associated with that wheel, preventing the wheel from moving axially.

The actuator 50 also has a pair of resilient members in the form of torsion springs 62 (of which only a small portion of one is visible in FIG. 6), mounted to one of the collar plates 52. The actuator also has a handle 64 which includes a pair of pillars 68 (only a small portion of one of which is visible in FIG. 6) which extend from the base of the handle 64. Each pillar 68 includes a hole (not shown) which is coxial with the pillar and which passes through the pillar from the top of the handle to the base of the handle. The handle is connected to one of the collar plates 52 by screws 66 which each pass through a hole within a respective one of the pillars 68.

Figure 7:
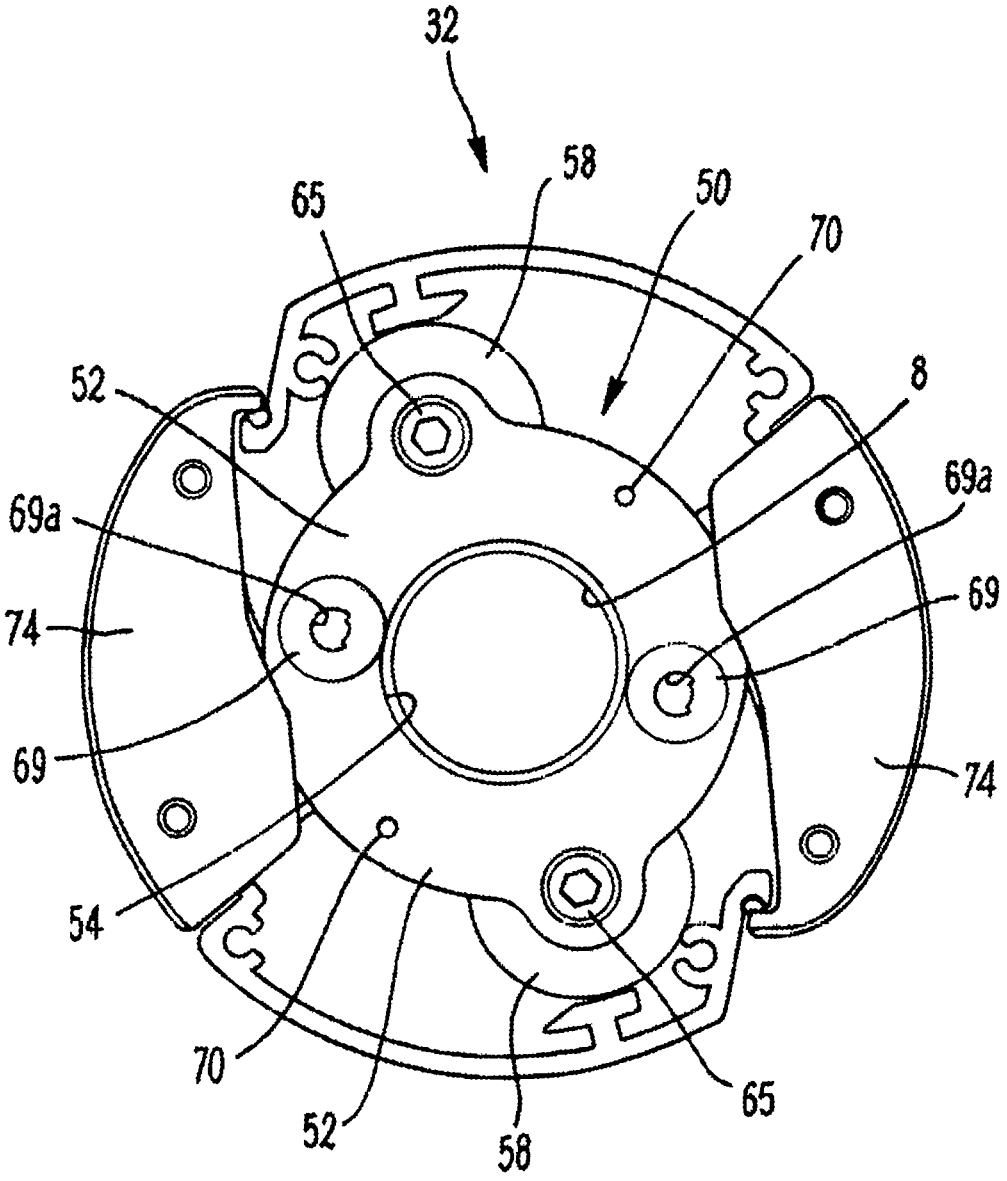
FIG. 7 is a plan view of an assembly comprising the spool support structure and the actuator of the embodiment.

FIG. 7 shows the spool support structure 32 with the actuator 50 in situ (but with the handle removed for clarity). In this embodiment the longitudinal axis of the actuator 50 has a common longitudinal axis with the spool support structure 32, therefore again it is to be understood that any reference to position or motion relative to the axis of the actuator may instead be considered to refer to the axis of the spool support structure, and vice versa. The actuator 50 is also substantially rotationally symmetrical about its longitudinal axis, and therefore the assembly of FIG. 5 (and indeed the entire spool support) is also substantially rotationally symmetrical.

FIG. 7 affords a clearer view of the screws 65 that attach the collar plates 52 to the spacer rods (54 in FIG. 6). The upper collar plate (shown in FIG. 7) to which the handle is attached includes a pair of generally cylindrical recesses 69. At the base of each of the recesses is a threaded hole 69*a*. The handle (64 in FIG. 6) is attached to the upper collar plate such that the pillars 68 of the handle 64 are received within the recesses 69 and screws 66 pass through the pillars and are received by the threaded holes 69*a* to secure the handle to the collar plate. This figure also shows that the collar plate 52 to which the handle is mounted has a pair of substantially diametrically-opposed holes 70, the significance of which will be described below. FIG. 7 also shows end plates 74 positioned on the lobes 4 so as to prevent ingress of contaminant such as dirt or dust. The fixing screws used to fix the end plates to the lobes of the main body are not shown The actuator 50 is movable between first and second positions relative to the main body (and thus the spool support structure 32). In this embodiment, it is movable by rotating it about its longitudinal axis (which is also the longitudinal axis of the main body 2 spool support structure 32, as outlined above). FIG. 7 shows the actuator in the second position.

Figure 8:
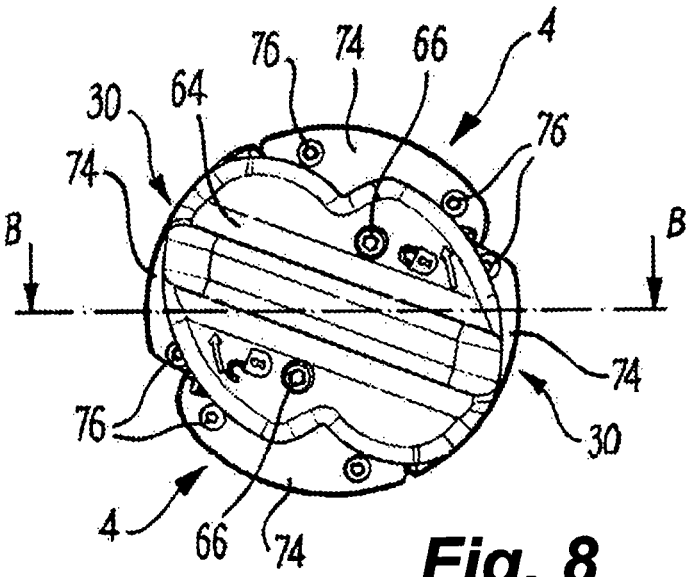
FIG. 8 is a plan view of the spool support according to the embodiment.
Figure 9:
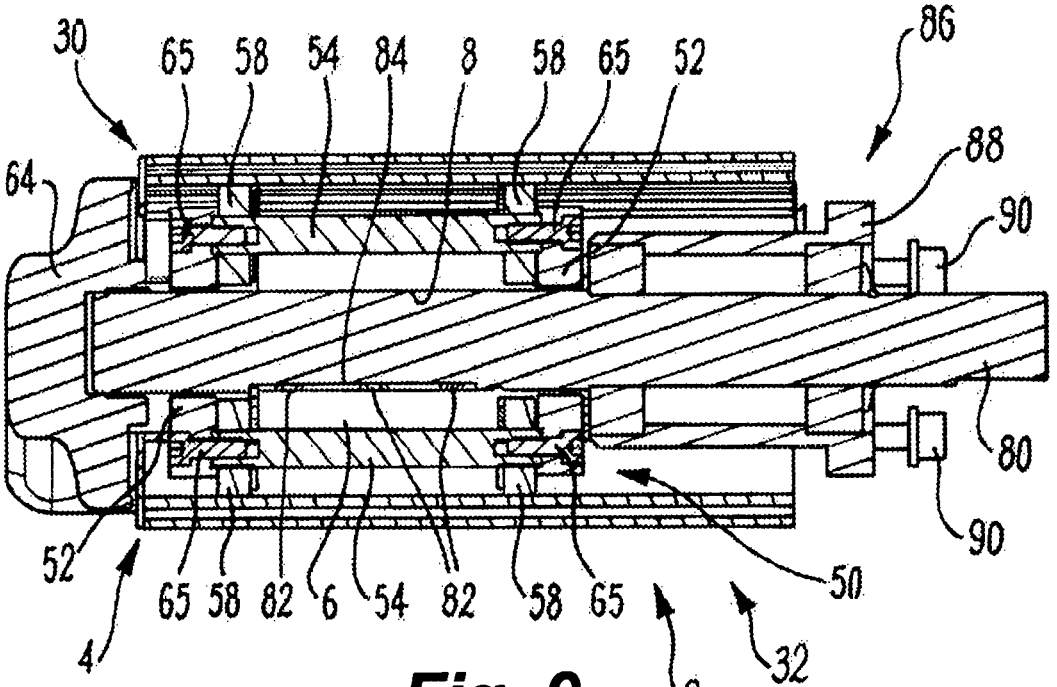
FIG. 9 is a lateral cross section of the spool support of FIG. 8, taken along line B-B.

FIGS. 8 and 9 show the fully assembled spool support. Cover plates 74 are mounted on the top ends of the lobes 4 and clamp portions 30, and are secured in place by screws 76 that are received in the screw engagement profiles (14 in FIGS. 1-5 and 7) described previously.

As well as the spool support, FIG. 9 also shows a mandrel 80, which acts as a drive shaft for the spool support. The mandrel is rotated by a motor (either directly or indirectly, for instance through a gear box or drive belt), which causes the spool support to rotate. The mandrel 80 is received within the bore 8 of the shroud 6, and is clamped in place by set screws 82 (barely visible in FIG. 9). The set screws 82 are received in the threaded bores (10 in FIGS. 2-4) of the shroud, and brace against a flat surface 84 provided on the mandrel 80. The mandrel 80 is supported by a bearing assembly 86, which has a base 88 for mounting the bearing assembly on a base plate of a machine via bolts 90. It will be appreciated that in other embodiments any appropriate method of securing the spool support to a mandrel may be used.

As described previously, the shroud 6 is positioned near the top of the main body 2 (and thus of the spool support structure 32). This is advantageous in that it provides space within the spool support structure 32 underneath the shroud 6 within which the bearing assembly 86 can be mounted for the sake of compactness. In addition, the shroud being near the top of the spool support structure 32 allows the pillars 68 by which the handle 64 is mounted to be relatively short, and therefore prone to less deflection when torque is applied to the handle as outlined below.

To assemble the spool support, the actuator 50 (except the handle 64) is first built around the shroud 6 of the main body 2. The spacer rods 54, with the wheels 58 attached, are placed outside the shroud between the lobes 4 and the collar plates 52 are bolted in place. The assembly comprising the main body 2 and actuator 50 (minus the handle 64) is then secured to the mandrel 80 as described above. After sliding the clamp portions 30 down into position, with their axle ridges (34 in FIG. 5) received within the axle sockets (18 in FIGS. 1-5) of the lobes 4, the end plates 74 are screwed into place and the handle 64 is bolted onto the upper collar plate 54.

Figure 10:
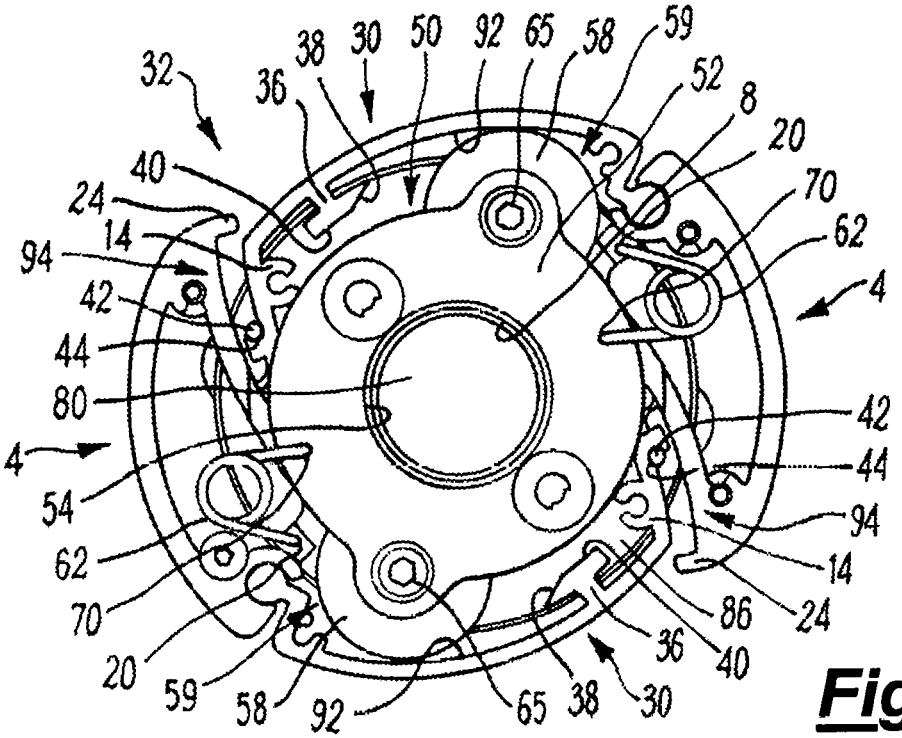
FIG. 10 is an axial cross section of the spool support of the embodiment, with clamp portions in retracted positions.
Figure 11:
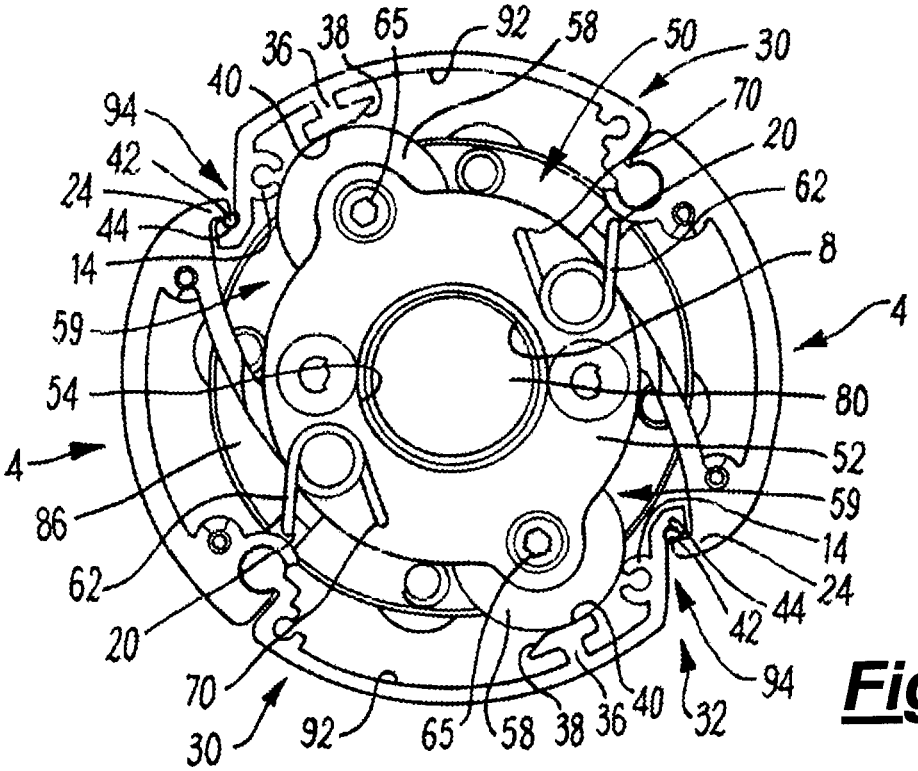
FIG. 11 is an axial cross section of the spool support of the embodiment, with its clamp portions in deployed positions.

Operation of the spool support will now be described, with reference to FIGS. 10 and 11. As described above, the clamp portions 30 of the spool support structure 32 are pivotable relative to the main body 2 between retracted and deployed positions, and the actuator 50 is rotatable between first and second positions relative to the spool support structure 32 (and thus the main body 2). FIG. 10 shows the clamp portions 30 in the retracted position with the actuator 50 in the first position, and FIG. 11 shows the clamp portions in the deployed position with the actuator in the second position.

The holes 70 in the upper collar plate 52 each receive one end of a torsion spring 62, the other end of which is received in a hole 20 in one of the lobes 4. Each spring 62 acts to urge apart the two holes 70, 20 within which its ends are received. With the actuator 50 in the first position, the springs 62 urging their respective holes 70, 20 apart acts to hold the actuator in that position. Similarly, with the actuator 50 in the second position, the springs 62 urging their respective holes 70, 20 apart acts to hold the actuator in that position. However, when the actuator 50 is in a position between these two extremes, an intermediate position, the holes 20, 70 of each spring 62 are closer together. The springs 62 urging their respective holes 20, 70 apart therefore urges the actuator 50 away from this intermediate position, towards the one of the first and second positions, whichever the actuator is nearer. The springs therefore provide an over-centre bias. As such, if the main body 2 and actuator 50 are in the first position or the second position and are disturbed (i.e. are moved relative to each other towards the intermediate position, for instance by a knock), the springs 62 act to return them to the position they were in. In other words, with the actuator 50 and main body 2 in the first position or the second position, the springs 62 resist relative rotation of the actuator 50 and main body 2. When it is desired to move the main body 2 and actuator 50 relative to one another from one of the first and second positions to the other, the user must simply move them past the intermediate position.

The ramp sections 36 and the ramp-engaging structures 59 co-operatively form a linkage which translates movement of the actuator 50 from the first position towards the second position, into actuation of the clamp portions 30, moving them from the retracted position towards the deployed position. With the clamp portions 30 in their retracted positions and the actuator 50 in the first position, rotating the handle 64 anticlockwise (from the perspective of FIGS. 10 and 11) moves the actuator towards the second position. This rolls the wheels 58 along the inner surfaces 92 of the clamp portions, towards the ramp sections 36. This movement cams the clamp portions 30 outwards (relative to the longitudinal axis) a certain distance from the retracted position. The outwards distance (relative to the retracted position) which movement of the wheels 58 along the inner surfaces 92 of the clamp portions, towards the ramp sections 36, produces is less than the outwards distance the clamp portion moves from the retracted position in order to reach the deployed position. Once the wheels 58 reach the ramp sections 36, continued anticlockwise movement of the actuator 50 forces the wheels up the ramp surfaces 38 of the ramp sections. This cams the ramp sections 36, and thus the clamp portions 30, outwards towards the deployed position. For the avoidance of doubt, the wheels are only able to move circumferentially about the longitudinal axis of the spool support. Reference to them moving 'up' the ramp is intended in a figurative sense and is not intended to imply any movement of the rollers towards the 'top' of the spool support (as defined previously), or upwards in any other frame of reference.

When the wheels 58 have rolled onto the circumferentially-extending faces 40 of the ramp sections 36, the clamp portions 30 have reached the deployed position. Continued anticlockwise movement of the actuator 50 rolls the wheels 58 along the circumferentially-extending faces 40, but does not cam the clamp portions 30 any further outwards (due to the faces 40 having a constant radial extent). Once the wheels 58 contact the screw-engagement profiles 14 of the clamp portions 30, the actuator 50 is in the second position and (in this embodiment) can move no further.

To move the clamp portions 30 back to the retracted position, the handle 64 is rotated clockwise. This rotates the actuator 50 clockwise, rolling the wheels 58 back down the ramp sections 36 and releasing the clamp portions 30. In this embodiment the clamp portions 30 are free to move to the retracted position under their own weight or by external influence (such as by an operator squeezing them inwards by hand). However, in other embodiments the clamp portions may be urged radially inwards from the deployed position by a biasing mechanism such as a resilient member.

Figure 12:
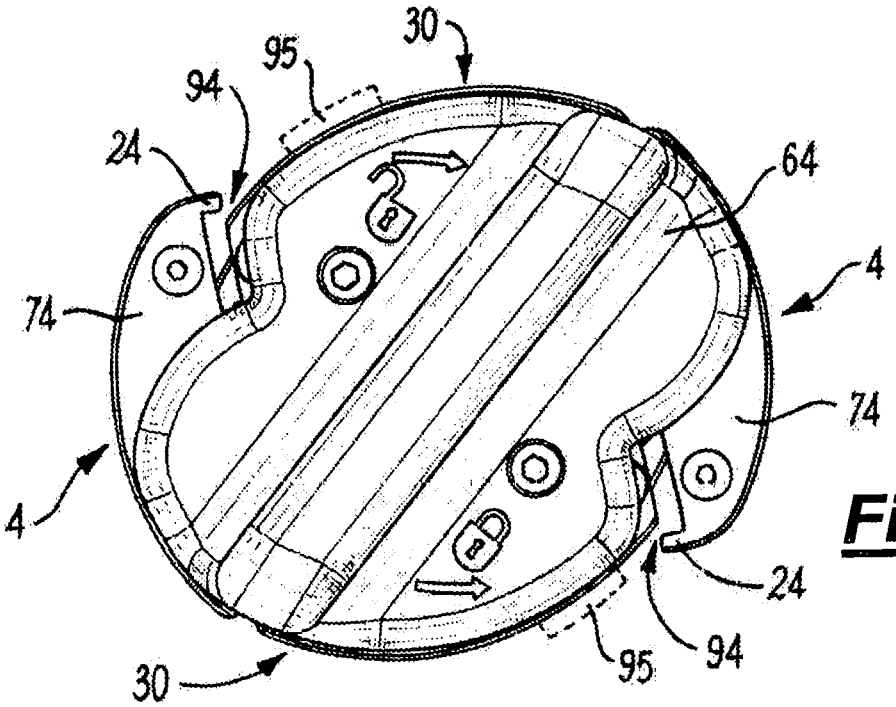
FIG. 12 is a plan view of the spool support of the embodiment, with its clamp portions in retracted positions.
Figure 13:
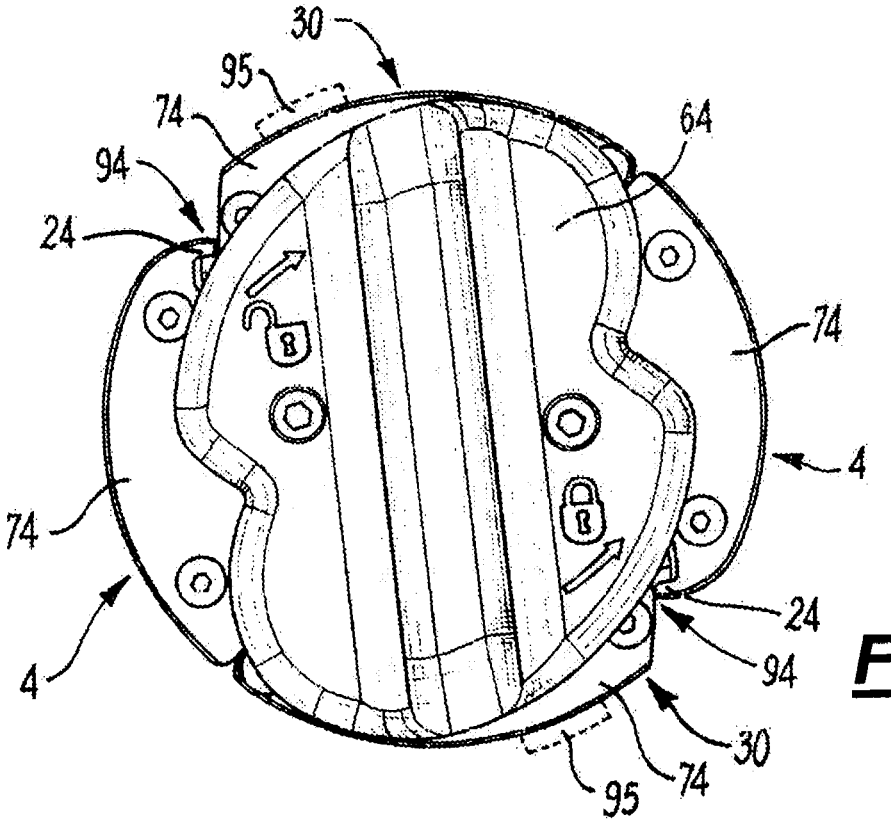
FIG. 13 is a plan view of the spool support of the embodiment, with its clamp portions in deployed positions.

FIGS. 12 and 13 show the spool support in an assembled configuration. FIG. 12 shows the spool support with the clamp portions 30 in their retracted positions and the actuator (50 in FIGS. 10 and 11) in the first position, and FIG. 13 shows the spool support with the clamp portions in their deployed positions and the actuator in the second position.

Returning to FIGS. 10 and 11 in combination with FIGS. 12 and 13, the insert 42 and groove 44 of each clamp portion 30 forms one of a pair 94 of counterposed jaws. The other jaw of each pair is formed by the adjacent rib 24 of a lobe 4. With the clamp portions 30 in the retracted position the pairs of jaws 94 are open, and with the clamp portions in the deployed position the pairs of jaws 94 are closed. When the spool support is to function as a take-up spool support, for example, an end of a label web (or other medium to be wound) can be attached to the spool support using either of the pairs of jaws 94. To do so, the pairs of jaws 94 are opened by moving the clamp portions 30 to the retracted position (by moving the actuator 50 to the first position). An end of a label web can then be inserted into one of the pairs of jaws 94, i.e. inserted between the insert 42 of one of the clamp portions 30 and the adjacent rib 24. The jaws 94 can then be closed by moving the actuator 50 to the second position (thereby moving the clamp portions 30 to the deployed position). Closing the jaws 94 grips the end of the web between the insert 42 and the rib 24, and the resilient nature of the insert allows it to be deformed by the rib so as to ensure firm contact without exerting sufficient pressure on the web to risk it being cut. The resilient insert 42 also allows the jaws 94 to function correctly with wider manufacturing tolerances than would be possible if neither of the jaws were deformable.

The clamp portions 30 being displaceable radially outwards by moving them towards the deployed position allows the spool support to grip the inside of a tube, such as an inner tube of a supply spool. In some embodiments part of the periphery of the spool support structure 32, such as one or both clamp portions 30, may be provided with a resiliently deformable portion for said engagement with a spool of label web (for instance it may engage with a core of the spool, or with an inner portion of the label web itself). An example of this is shown in FIGS. 12 and 13—resiliently deformable pads 95 are shown located on both clamp portions 30 at the ends of the clamp portions 30 which are remote from the pivot for each of the clamp portions. This may allow a single spool support accommodate and engage different spools with a range of spool core internal diameters. The resiliently deformable portion may also improve grip on an inner tube (for example) by conforming to its shape. Sufficient grip is important so as to ensure that the inner tube cannot rotate relative to the spool support, which may (for example) prevent the position of labels on a web from being deduced from the angular position of the spool support. Furthermore, relative rotation between the spool and spool support may mean that it is not possible to achieve a desired tension in label web between take-up and supply spools.

Given the importance of sufficient traction between the spool support and the spool, part of the periphery of the spool support structure 32, such as one or both clamp portions 30, may be provided with a high friction surface to improve grip. This may be as well as or instead of the above resiliently deformable portion. In one arrangement, the portions of the outer surfaces 12 of the clamp portions 30 which are near to the ramp sections 36 may have an elastomeric mat provided thereon. These elastomeric pads would be resiliently deformable, but would also provide a high friction surface.

With the clamp portions 30 in the deployed position, the outer periphery of the spool support structure 32 is substantially circular in axial cross section (perpendicular to the longitudinal axis, and/or axis of rotation). More particularly, the spool support structure 32 is substantially cylindrical. This is of importance as otherwise, a spool formed thereon (for instance by winding material directly onto it) would be non-circular in cross section, or a spool with a core supported thereby would be distorted into a non-circular shape. This may introduce additional complexity in any calculations which would be necessary, for example, to deduce the amount and/or rate of linear feed of label web based on the angular displacement of the spool support (and the radius of the spool). The spool support and the components thereof being rotationally symmetric is preferred in some embodiments for the same reasons. If this was not the case, the force provided by the clamp portions 30 may not be balanced about the circumference of the clamp support, which again may cause a spool formed thereon or supported thereby to become non-circular in cross section.

Figure 14:
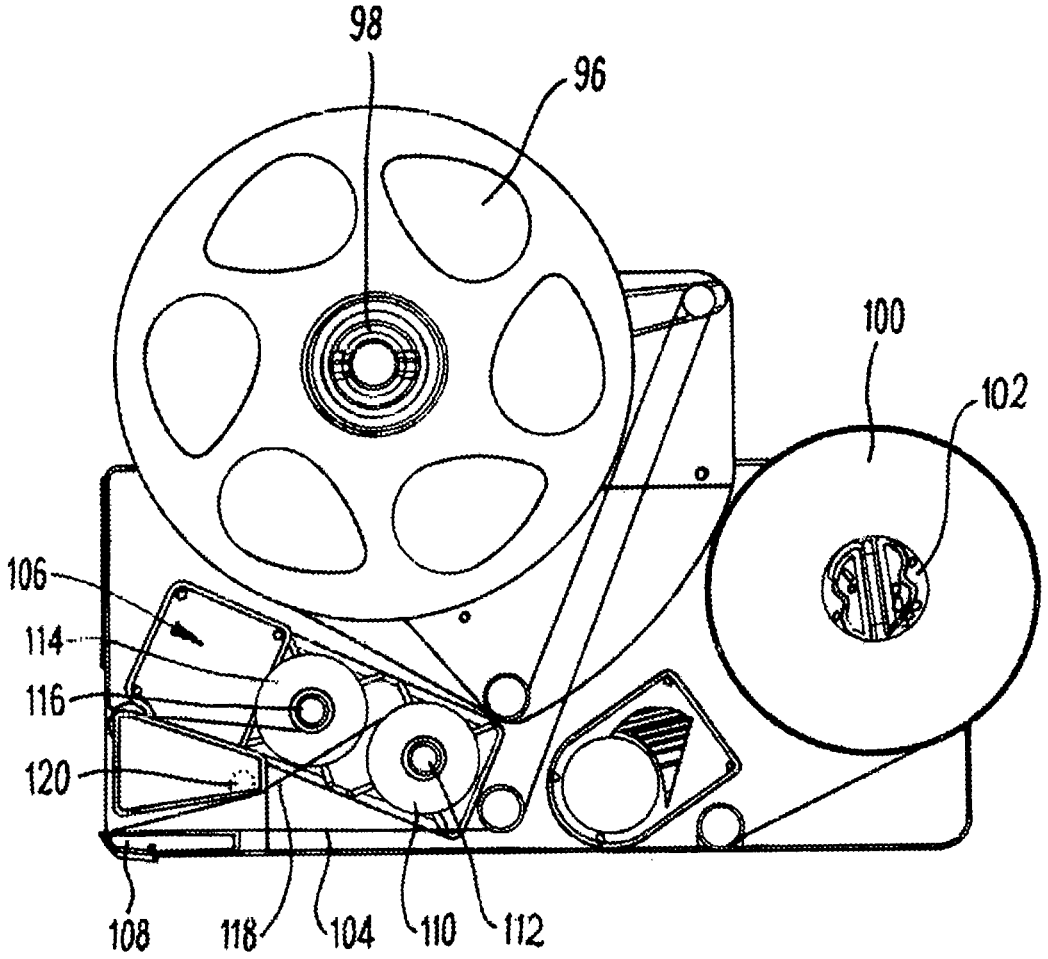
FIG. 14 is a cutaway plan view of a labelling machine comprising the spool support of the embodiment.

FIG. 14 shows the spool support installed on a labelling machine. The machine has a supply spool 96 supported on a supply spool support 98, and a take-up spool 100 supported on a take-up spool support 102, with a length 104 of label web running along a web path. The labelling machine has a drive mechanism which is hidden from view in FIG. 14, but which rotates the take-up spool support 102. The label web 104 travelling along the web path passes from the supply spool, past a printer 106, past a peel beak 108 and then onto the take-up spool.

The printer 106 has a supply spool 110 of printer ribbon supported on a supply spool support 112, and a take-up spool 114 of printer ribbon supported on a take-up spool support 116, with a length 118 of printer ribbon running along a printer ribbon path. The printer 106 has drive mechanisms (which are hidden from view in FIG. 14) which rotate the take-up spool support 116 and the supply spool support 114. The printer ribbon 118 running along the printer ribbon path passes, in close proximity to the web path, across a print head 120. As the label web and printer ribbon pass across it, the print head may selectively transfer ink from the printer ribbon onto the labels on the web.

In this embodiment the take-up spool support of the labelling machine is a spool support according to the invention, whereas the supply spool support of the labelling machine and both spool supports of the printer are of conventional design. In other embodiments however, any of the supply spool support of the labelling machine, the take-up spool support of the printer and/or the supply spool support of the printer may be spool supports according to the invention.

Figure 15:
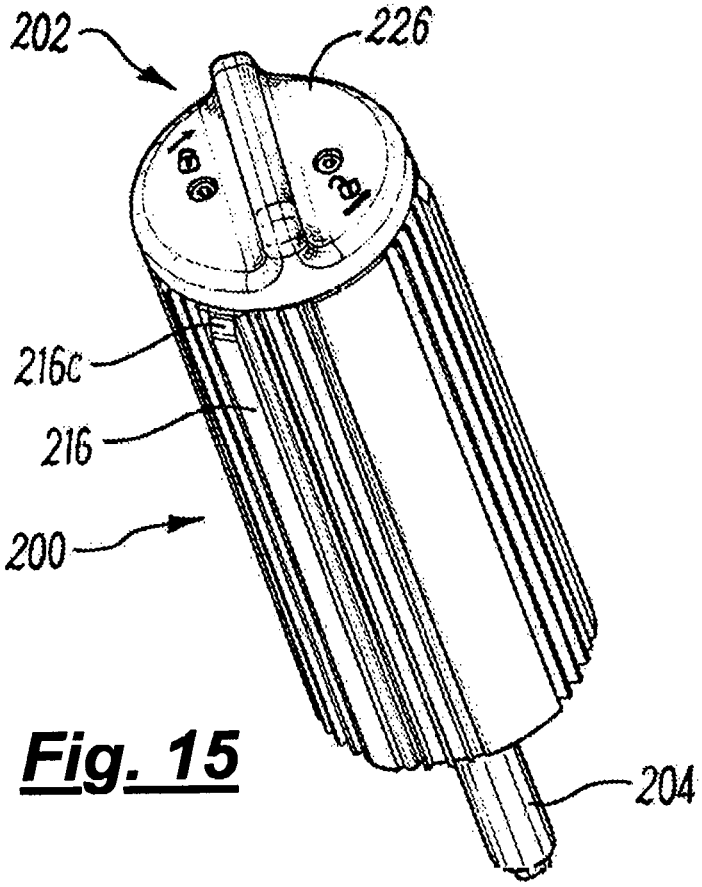
FIG. 15 is a perspective view of a spool support according to an embodiment of the invention.
Figure 16:
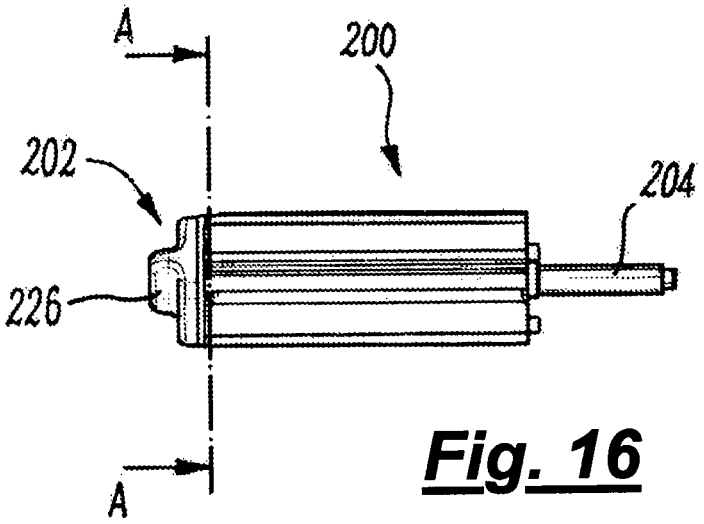
FIG. 16 is a plan view of the spool support of the embodiment shown in FIG. 15.

FIG. 15 shows an alternative embodiment of a spool support which may be particularly suitable for a supply spool. The spool support comprises a spool support structure 200, and an actuator 202 which is configured to move the spool support structure 200 between deployed and retracted positions. The spool support structure 200 has an outer surface which is generally cylindrical, and which is arranged to grip the internal surface of a core (not shown), such as, for example a label core. The spool support structure 200 is mounted upon, and supported by, a mandrel 204, which also acts as a drive shaft for the spool support. The mandrel is operated as described above with reference to FIG. 9. FIG. 16 shows the spool support of FIG. 15 in side-elevation. It will be appreciated that the spool support structure 200 may alternatively grip other cores such as for example, ribbon cores.

Figure 17:
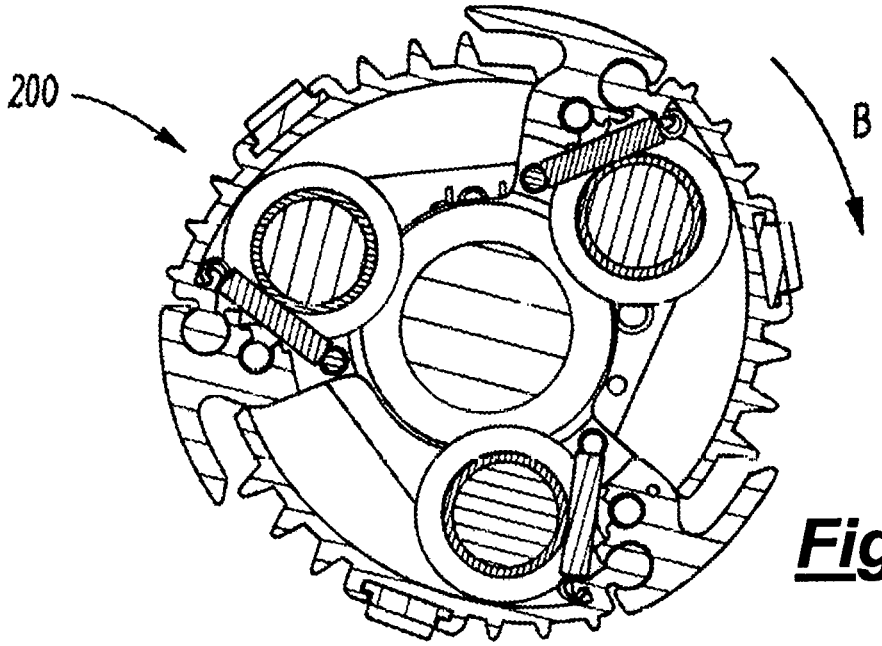
FIG. 17 is an axial cross section of the spool support of the embodiment, with its clamp portions in retracted positions.
Figure 18:
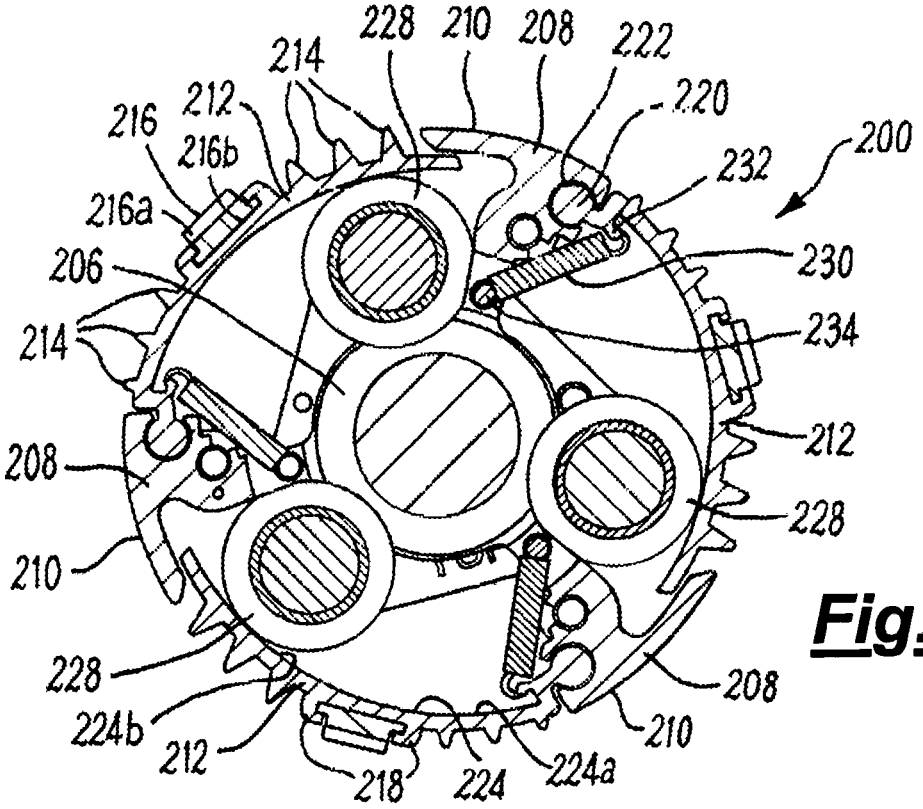
FIG. 18 is a plan view of the spool support of the embodiment, with its clamp portions in deployed positions.

FIGS. 17 and 18 show cross-sectional views of the spool support structure 200 in more detail in the retracted and deployed positions respectively. FIGS. 17 and 18 are cross-sectional views at section A-A in FIG. 16. The spool support 200 shown in FIGS. 15 to 18 is generally similar in construction to that shown in FIGS. 1 to 13, and comprises a main body 206. The main body 206 has three lobes 208, connected together by a substantially tubular shroud with a bore centrally positioned therein. The shroud defines a main body longitudinal axis which runs through the bore, running horizontally from the perspective of FIG. 16, and running into the page from the perspective of FIGS. 17 and 18.

The lobes 208 are substantially identical, and are substantially equally distributed about the main body longitudinal axis, spaced apart by 120 degrees. The main body 206 is therefore substantially rotationally symmetrical (order 3) about its longitudinal axis. Each lobe 208 (and thus the main body 206) forms part of the spool support structure 200. Each lobe 208 has an arcuate outer surface 210 which forms part of the outer periphery of a spool support structure 200.

The main body 206 has three clamp portions 212 attached thereto, each clamp portion 212 being pivotally attached to a respective lobe 208. The spool support structure 200 has a common longitudinal axis with the main body 206, therefore it is to be understood that reference herein to position or motion relative to the axis of the main body 206 may equally be considered to refer to the axis of the spool support structure 200, and vice versa. Like the lobes 208, the clamp portions 212 are substantially identical and are substantially equally distributed about the main body longitudinal axis, spaced apart by 120 degrees. The spool support structure 200 is therefore also substantially rotationally symmetrical (order 3) about its longitudinal axis.

The clamp portions 212 are generally arcuate. The outer surface of the clamp portions 212 is provided with a plurality of ribs 214. For example, each of the clamp portions may be provided with six ribs 214. The ribs 214 each extend from the outer surface of the clamp portion and are each generally triangular in cross-section. The ribs 214 run along the length of the clamp portions, parallel to the longitudinal axis of the spool support structure 200. In other embodiments the ribs 214 may have any appropriate configuration.

The outer surface of each of the clamp portions 212 is further provided with a resiliently deformable pad 216. The resiliently deformable pad 216 extends along the length of the clamp portions 212, parallel to the longitudinal axis of the spool support structure 200. The resiliently deformable pad 216 may, for example, be formed from a rubber-like material. The resiliently deformable pad 216 has a top-hat cross-section in plane A-A, having a wider portion **216*a* at its base (adjacent to the outer surface of the clamp portion 212, and a narrower portion 216*b* which extends away from the clamp portion 212. The outer surface of the clamp portion 212 is provided with two retaining members 218, which together define a channel within which the wider portion 216*a* of the resiliently deformable pad 216 is received. When inserted between the two retaining members 218, the narrower portion 216*b* of the resiliently deformable pad 216 extends from between the retaining members 218**.

The resiliently deformable pad 216 has a generally uniform cross-section along its length, with the exception of an end portion 216*c* (see FIG. 15). The end portion 216*c* is tapered at the end closest to the actuator handle (i.e. the end of the spool support structure 200 onto which spools are loaded). The tapered end portion 216*c* ensures that should an operator attempt to load a spool onto the spool support while the spool support is in the deployed position (rather than the retracted position) the spool will only travel a short distance onto the spool support before binding with the gradually increasing thickness of rubber-like material. On the other hand, if a uniform profile is used, the resiliently deformable pad 216 may be pushed along by the action of the spool abutting end surfaces of the resiliently deformable pad 216, possibly causing the resiliently deformable pad 216 to be pulled from the retaining members 218.

In other embodiments, the resiliently deformable pads 216 may be held in place by other means. Furthermore, in other embodiments the resilient deformable pads 216 may have any appropriate configuration and may be formed of any appropriate material.

Each clamp portion 212 has a substantially cylindrical axle ridge 220 which is received in a substantially cylindrical slot 222 of one of the lobes 208. The axle ridge 109 and axle socket 110 co-operatively form a hinge mechanism, defining a pivot axis about which the clamp portion 212 can pivot relative to the main body 206. The pivot axes in this embodiment are substantially parallel to the longitudinal axis of the main body 206, and are substantially collinear with the axes of the cylindrical slots 222. Each clamp portion 212 can pivot relative to the main body 206 between a retracted position and a deployed position. FIG. 18 shows the clamp portions 212 in their deployed positions, while FIG. 17 shows the clamp portions 212 in their retracted positions.

Each clamp portion 212 has an inner surface 224. The inner surface 224 is generally arcuate, extending generally circumferentially about the longitudinal axis. In the shown embodiment, each clamp portion 212 is a section of extrusion, and indeed each of the three clamp portions 212 may be sections of the same extrusion (which in this case is made of aluminium). In other embodiments, the clamp portions 212 may be manufactured in any appropriate way.

The actuator 202 of the spool support comprises an actuator handle 226 (see FIGS. 15 and 16). The actuator handle 226 may be similar to the actuator handle 64 described with reference to FIGS. 1 to 14, and in particular FIG. 6. However, in contrast to the actuator 64, the actuator 202 has three wheels 228, which are equally spaced about the longitudinal axis. In other respects, the actuator 202 is similar to that described with reference to FIG. 6, with adaptations made so as to accommodate the three wheels 228. In a similar fashion to that described with reference to the actuator illustrated in FIG. 6, the actuator 202 comprises an assembly of collar plates, lugs, and spacer rods, which co-operate to support the wheels 228 such that they are fixed axially, but free to rotate around the spacer bars (for example the wheels being mounted on a bearing).

The clamp portions 212 are each resiliently coupled to the main body 206 by a resilient member 230. The resilient members 230 are, in this embodiment, springs. In other embodiments, the resilient members 230 may take any appropriate form. A first end of each of the resilient members 230 is attached to the clamp portions 212 by a lip 232, which extends from the clamp portion 212 proximate to the cylindrical axle ridge 220. A second end of each of the resilient members 230 is attached to the main body 206 via a screw 234. The resilient members 230 are arranged to bias the clamp portions 212 into the retracted position. Note, the resilient members 230 are provided in addition to the springs 62 which are described above with reference to other embodiments.

The actuator 202 is movable between first and second positions relative to the main body 206 (and thus the spool support structure 200). In this embodiment, it is movable by rotating it about its longitudinal axis (which is also the longitudinal axis of the main body 206 and the spool support structure 200, as outlined above). FIG. 17 shows the actuator in the first position, while FIG. 18 shows the actuator in the second position.

Operation of the spool support 200 will now be described, with reference to FIGS. 17 and 18. As described above, the clamp portions 212 of the spool support structure 200 are pivotable relative to the main body 206 between retracted and deployed positions, and the actuator 202 is rotatable between first and second positions relative to the spool support structure 200 (and thus the main body 206). FIG. 17 shows the clamp portions 212 in the retracted position with the actuator 202 in the first position, and FIG. 18 shows the clamp portions 212 in the deployed position with the actuator 202 in the second position. Thus, when the actuator 202 is in the first position, the clamp portions 212 are in the retracted position and when the actuator 202 is in the second position, the clamp portions 212 are in the deployed position.

The actuator 202 has a resilient member (not shown) in the form of a torsion spring. The torsion spring may be arranged in a similar fashion to each of the springs 62 which is described above with reference to FIGS. 10 and 11—i.e. the spring is arranged to urge the actuator 202 away from an intermediate position between the first and second positions, towards the one of the first and second positions, whichever the actuator 202 is nearer. The spring therefore provides an over-centre bias. As such, if the main body 206 and actuator 202 are in the first position or the second position and are disturbed (i.e. are moved relative to each other towards the intermediate position, for instance by a knock), the spring acts to return them to the position they were in. In other words, with the actuator 202 and main body 206 in the first position or the second position, the spring resists relative rotation of the actuator 202 and main body 206. When it is desired to move the main body 206 and actuator 202 relative to one another from one of the first and second positions to the other, the user must simply move them past the intermediate position.

The inner surfaces 224 of the clamp portions 212 engage with an outer surface of the wheels 228. The inner surface 224 comprises a first portion 224*a* and a second portion 224*b*. The first portion 224*a* has a circumferential ramp profile, such that when the actuator 202 is rotated about the longitudinal axis in a clockwise direction starting from the first position, as illustrated by arrow B in FIG. 16, the wheel 228 rolls across the first portion 224*a* of the inner surface 224 of the clamp portion 212 forcing the clamp portion 212 to pivot outwards from the longitudinal axis. The resilient member 230 acts to resist the action of the wheel 228. However, provided the turning force applied to the handle 226 of the actuator 202 forcing the clamp portion 212 outwards is greater than the resistance of the resilient member 230, the clamp portion 212 will pivot outwards towards the deployed position.

As the point of contact between the wheel 228 and the inner surface 224 reaches the second portion 224*a* of the inner surface 224, the clamp portion 212 reaches the deployed position, and the actuator 202 the second position (as shown in FIG. 18). In deployed position, the end of the clamp portion 212 which is furthest from the pivot is be arranged such that it does not make contact with the end of the lobe 208 to which the next clamp portion 212 is attached (i.e. a lobe adjacent to the lobe to which the clamp portion is pivotably connected). This clearance ensures that any force generated by the action of the actuator 202 is applied to a clamped spool, rather than acting on a part of the spool support structure 200.

The profile of the first portion 224*a* of the inner surface 224 of the clamp portion 212 may be described as having a ramp profile. This ramp profile is a gradual ramp, providing a mechanical advantage, such that a predetermined force which is applied to the actuator handle 226 is translated into a larger force acting on the clamping member 212, and a relatively large movement of the actuator handle 226 is translated into a relatively small movement by the clamp portion 212.

Once the second position of the actuator 202 is reached, the clamp portion 212 is in the deployed position, and no further motion is required. The second portion 224*b* of the inner surface 224 is therefore arranged to have a circumferential profile. The second portion 224*b* may be considered to be a plateau portion (i.e. as opposed to a ramp portion). That is, in the deployed position, the second portion 224*b* of the inner surface 224 of the clamp portion 212 describes an arc of a circle having its centre at the longitudinal axis of the spool support structure 200. This ensures that the resilient member 230, which exerts a force on the clamp portion 212 to urge it towards the retracted position, does not, when in the deployed position, exert any force which would cause the actuator 202 to move away from the second position. That is, the force exerted by the clamp portion 212 as a result of the resilient member 230, acts in a direction which intersects the axis of rotation of the actuator 202, and thus does not have any component in the circumferential direction, and does not act to urge the wheel 228 towards the first portion 224*a*.

A spool which is to be clamped on the spool support structure 200, may, for example have a cardboard core. The cardboard core may be relatively deformable, and may thus be deformed by the action of the clamp portion 212. For example, at least a portion of a cardboard core may be forced out of circular (i.e. out of its generally circular cross-section) by a clamping force which was applied at only a small number of locations. In order to reduce the extent to which any such eccentricity occurs, the spool support structure 200 is provided with three clamping portions 212 (rather than the two which hare described with reference to FIGS. 1-14. This increases the number of contact points between the spool support structure 200 and the core. A further reduction in core eccentricity could be brought about by using a greater number of clamping portions 212.

Further, while the primary engagement between the inner surface of a clamped core and the outer surface of the spool support structure 200 is with the resiliently deformable pads 216, the ribs 214 are provided to improve the circularity of the clamped core. When in the deployed position, the outermost point of each of the ribs 214 is at a substantially identical radius from the longitudinal axis, such that they each define a point on a circle. Further, the outer surface 210 of each of the lobes 208 each define an arc, having a common radius and centre with that of the ribs 214 (when in the deployed position). The outermost part of each of the resiliently deformable pads 216 extends slightly further than each of the outer surface 208 and ribs 214, however, when in contact with the inner surface of a clamped core, the resiliently deformable pads 216 deform such that the outer surface of the resiliently deformable pads 216, and the outermost points at the outer surface 210 and each of the ribs 214 is at a substantially identical radius from the longitudinal axis, such that they each define a point on a circle. This reduces the extent to which clamping a core at a small number of points (e.g. 3) causes deformation of the core. Therefore, when clamped, a core is clamped in a substantially circular shape, with the ribs 214 reducing the extent to which the core is deformed by the action of the clamping surfaces. It will be appreciated that the ribs 214 may reduce or prevent a clamped core from sagging between the clamping surfaces.

It will be appreciated that the clamp portions 212 could alternatively be provided without ribs, with a continuous outer surface which was appropriately modified so as to support the core in a circular shape. However, the use of the ribs 214 allows the core to be supported (as described above) while also reducing the weight and material cost of the spool support structure 200.

It will further be appreciated that the transmission of any torsional forces between the spool support structure 200 and the clamped core is facilitated by the resiliently deformable pads 216, which grip the inner surface of the core. The use of a rubber-like material is an example of a material which would provide a high-friction interface between the inner surface of the core and the outer surface of the spool support structure 200, allowing torsional forces to be transmitted effectively. In other embodiments any other appropriate structure or material may be used provided torsional forces can be transmitted effectively between the spool support structure and the spool.

To move the clamp portions 212 back to the retracted position, the handle 226 is rotated anti-clockwise. This rotates the actuator 202 anti-clockwise, rolling the wheels 228 back down the ramped first portions 224*a* of the inner surface 224 of the clamp portions 212, until the actuator 202 is in the first position, thereby releasing the clamp portions 212. The clamp portions 212 are move to the retracted position by the action of the resilient members 230.

It will be appreciated that numerous modifications to the above described design may be made without departing from the scope of the invention as defined by the appended claims. For instance, though in the above embodiment the lobes are integral to one another, in other embodiments this may not be the case. For instance, the main body may comprise a shroud to which one or more lobes are separably attached. Further, though in the above embodiment the ramp sections are discrete features, in other embodiments they may be contiguous with the inside surface of the clamp portions.

Although in the above described embodiment the main body comprises a central shroud with radially-extending lobes, in other embodiments it may take any other suitable form. For instance, it may be substantially cylindrical with one or more clamp portions mounted internally or externally thereto. Similarly, the clamp portion or portions may take any other suitable form. For instance, they may not have arcuate outer surfaces but instead be provided with one or more protrusions for engagement with a portion of windable material.

In another alternative arrangement, the main body may not define any of the outer periphery of the spool support structure, the outer periphery being defined entirely by the clamp portions. For instance, such an arrangement may have a main body in the form of a central hub, enclosed within a substantially circumferential array of clamp members.

Though in the described embodiment the spool support is mounted to a mandrel using set screws bracing against a flat surface on the mandrel, in other arrangements the spool support may be mountable on a mandrel in any other suitable fashion. For instance, a component of the spool support (such as the main body or the actuator) may be mountable to the spindle via mutually-engageable connection features such as interlocking lugs.

For the avoidance of doubt, though movement of the actuator and main body relative to one another between first and second positions has been described in relation to the actuator being moved while the main body (and thus the spool support structure) remains stationary, this is by way of example only. In alternative arrangements or methods of use, the main body may be moved while the actuator remains stationary, or both said components may be movable simultaneously.

Additionally, it is to be understood that clamping an end of a web using the jaws when the spool support is used as a take-up spool support, and clamping an inner tube using the outer periphery of the spool support structure when the spool support is used as a supply spool support, are merely illustrative examples. Either clamping method may be utilised in any suitable context. For instance, the spool support may be used as a take-up spool support, but may grip the inside of an inner tube onto which the take-up spool is to be wound.

It is to be understood that though pivotal motion of the clamp portions has been described in relation to the clamp portions having axle ridges received in axle sockets on the main body, a spool support according to the present invention may utilise any other suitable arrangement which enables the clamp portion to pivot relative to the main body. For instance, the axle sockets may be provided on the clamp portions and the axle ridges on the main body. As another alternative, the clamp portions may comprise substantially cylindrical pins projecting along the pivot axis into sockets (such as bores or annular projections) on the main body, or the clamp portions may comprise the sockets and the main body the pins.

As previously discussed, in labelling machines in which the label web is driven along the web path by rotation of the take up spool supported by a known take up spool support, the take up spool can become tightly wound onto the take up spool support, making removal of the take up spool from the take up spool support difficult. A spool support according to the present invention overcomes this problem. This is because if a spool support according to the present invention is utilised as a take up spool support in such a situation, when the clamp portion is moved from the deployed position to the retracted position, not only does this place the opposing jaws in an open configuration such that the end of the web can be removed from between the jaws, but also the pivoting movement of the clamp member reduces the effective diameter of significant portion of the outer periphery of the spool support thereby enabling removal of the take up spool from the take up spool support even if the take up spool is tightly wound onto the take up spool support.

The described and illustrated embodiment is to be considered as illustrative and not restrictive in character, it being understood that only a preferred embodiment has been shown and described and that all changes and modifications that come within the scope of the invention as defined in the claims are desired to be protected. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

Optional and/or preferred features as set out herein may be used either individually or in combination with each other where appropriate and particularly in the combinations as set out in the accompanying claims.

The invention claimed is:

1. A spool support for supporting a windable material, the spool support comprising:

a main body, an actuator, and a clamp portion;

wherein the actuator is configured to rotate relative to the main body between a first position and a second position; and wherein the clamp portion is pivotably connected to the main body, the actuator actuating the clamp portion such that the clamp portion pivots relative to the main body between a retracted position when the actuator is in the first position and a deployed position when the actuator is in the second position; and wherein the clamp portion defines at least one jaw of a pair of opposed jaws, the jaws comprising an open configuration when the clamp portion is in the retracted position, in which insertion or removal of a portion of windable material is permitted, and a closed configuration when the clamp portion is in the deployed position, in which insertion or removal of windable material from between the jaws is not permitted.

2. A spool support according to claim 1, wherein the spool support is configured to attach a portion of windable material to the spool support when the clamp portion is in said deployed position, and configured to allow removal of a portion of windable material from the spool support when the clamp portion is in said retracted position.

3. A spool support according to claim 1, wherein the main body, and clamp portion cooperatively define a spool support structure, the spool support structure defining a longitudinal axis and having an outer periphery that surrounds the longitudinal axis, the outer periphery being configured for direct or indirect engagement with said windable material.

4. A spool support according to claim 3, wherein the outer periphery is configured to engage a core around which said windable material is wound.

5. A spool support according to claim 3, wherein with the clamp portion defines at least part of the outer periphery of the spool support structure.

6. A spool support according to claim 5, wherein the part of e outer periphery defined by the clamp portion includes a resiliently deformable portion suitable for said engagement with said windable material.

7. A spool support according to claim 5, wherein the part of the periphery defined by the clamp portion includes an elastomer.

8. A spool support according to claim 3, wherein when the clamp portion is in the deployed position, the outer periphery of the spool support structure is substantially circular in longitudinal cross section.

9. A spool support claim 3, wherein at least part of the clamp portion is spaced a greater distance from the axis in the deployed position said at least part of the clamp portion is spaced from the axis in the retracted position.

10. A spool support according to claim 1, wherein the clamp portion is pivotable about a pivot axis that is substantially parallel to a longitudinal axis of the spool support structure.

11. A spool support according to claim 1 wherein one jaw of said pair of jaws is provided by the clamp portion and the other jaw is provided by the main body.

12. A spool support according to claim 1, further comprising a ramp and a ramp-engaging structure, one of which is provided by the actuator and the other of which is provided by the clamp portion, the ramp and ramp-engaging structure being configured such that said relative movement of the actuator and main body from the first position to the second position moves the ramp-engaging structure up the ramp, thereby camming the clamp portion into the deployed position.

13. A spool support according to claim 12 wherein the ramp-engaging structure includes a roller or wheel configured to roll up the ramp during said relative movement of the actuator and main body from the first position to the second position.

14. A spool support according to claim 12, wherein the or each clamp portion comprises an inner surface, a first portion of which is configured as the ramp and a second portion which is configured as a plateau portion having a substantially constant radius from a longitudinal axis when in the deployed position.

15. A spool support according to claim 14 wherein the or each clamp portion is biased towards the retracted position by a second resilient member, and wherein the clamp portion and the second resilient member are configured such that when the clamp portion is in the deployed position the force, resulting from the second resilient member acting on the clamp portion, exerted by the clamp portion on the ramp engaging portion has a direction which intersects an axis of rotation of the ramp engaging portion, such that the force, resulting from the second resilient member acting on the clamp portion, exerted by clamp portion on the ramp engaging portion does not urge the ramp engaging portion towards the ramp.

16. A spool support according to claim 1, further comprising a resilient member configured to urge the actuator relative to the main body towards the first position when disturbed therefrom.

17. A spool support according to claim 16, further comprising a resilient member configured to urge the actuator relative to the main body towards the first position when disturbed therefrom; wherein the resilient member configured to urge the actuator relative to the main body towards the first position is the same as the resilient member configured to urge the actuator relative to the main body towards the second position.

18. A spool support according to claim 1, further comprising a resilient member configured to urge the actuator relative to the main body towards the second position when disturbed therefrom.

19. A spool support according to claim 1, wherein the actuator and main body are movable relative to one another between the first and second positions via an intermediate position, the spool support further comprising a resilient member configured to urge the actuator and main body away from the intermediate position, so that when the actuator and the main body are in the first position the resilient member urges the actuator and the main body into the first position, and when the actuator and the main body are in the second position the resilient member urges the actuator and the main body into the second position.

20. A spool support according to claim 1, further comprising an additional clamp portion, wherein the additional clamp portion is pivotably connected to the main body, the actuator actuating the additional clamp portion such that the additional clamp portion pivots relative to the main body between a retracted position when the actuator is in the first position and a deployed position when the actuator is in the second position.

* * * * *